US011713177B1

(12) United States Patent
Jackson et al.

(10) Patent No.: US 11,713,177 B1
(45) Date of Patent: Aug. 1, 2023

(54) SHIPPING MAILER

(71) Applicant: Packaging Corporation of America, Lake Forest, IL (US)

(72) Inventors: Keith A. Jackson, Round Lake, IL (US); James D. Southwell, Long Grove, IL (US); Nicholas A. Philips, Sugar Grove, IL (US)

(73) Assignee: Packaging Corporation of America, Lake Forest, IL (US)

( * ) Notice: Subject to any disclaimer, the term of this patent is extended or adjusted under 35 U.S.C. 154(b) by 0 days.

(21) Appl. No.: 16/945,333

(22) Filed: Jul. 31, 2020

Related U.S. Application Data

(60) Provisional application No. 63/020,517, filed on May 5, 2020, provisional application No. 62/881,240, filed on Jul. 31, 2019.

(51) Int. Cl.

| | |
|---|---|
| ***B65D 81/03*** | (2006.01) |
| ***B65D 27/00*** | (2006.01) |
| ***B65D 27/38*** | (2006.01) |
| *B65D 27/14* | (2006.01) |

(52) U.S. Cl.
CPC ..... *B65D 81/03* (2013.01); *B65D 27/005* (2013.01); *B65D 27/38* (2013.01); *B65D 27/14* (2013.01)

(58) Field of Classification Search
CPC ..... B65D 81/03; B65D 27/005; B65D 27/38; B65D 27/14
USPC ..... 383/105, 119
See application file for complete search history.

(56) References Cited

U.S. PATENT DOCUMENTS 1,849,065 A * 3/1932 Biederman ..... B65D 65/44 229/90
2,689,079 A * 9/1954 Timer ..... B65D 27/005 229/72
3,144,979 A * 8/1964 Frank ..... B65D 5/0227 206/521
3,501,084 A 3/1970 Harrison
3,592,380 A 7/1971 Gerard
(Continued)

FOREIGN PATENT DOCUMENTS

DE 8229927 U 12/1982
DE 9200839 U1 * 7/1993
(Continued)

OTHER PUBLICATIONS

Machine translation of WO-2017024797-A1.*
(Continued)

*Primary Examiner* — Jes F Pascua
(74) *Attorney, Agent, or Firm* — Klarquist Sparkman, LLP

(57) ABSTRACT

A shipping mailer has a first wall and a second wall that at least partially define an interior of the shipping mailer. The shipping mailer has a closed first end portion and a second end portion, the second end portion comprising an opening sealable by a closure. A plurality of corrugations are coupled to the first wall and to the second wall in the interior of the shipping mailer. The corrugations of the first wall and the corrugations of the second wall have respective preformed fold lines at the closed first end portion about which the first wall and the second wall are configured to fold when an object is inserted into the shipping mailer to create an end wall extending between the first and second walls at the closed first end portion of the shipping mailer.

28 Claims, 29 Drawing Sheets

(56) References Cited

U.S. PATENT DOCUMENTS

| | | | | |
|---|---|---|---|---|
| 3,743,173 | A | 7/1973 | Lasker | |
| 3,944,131 | A * | 3/1976 | Weiss | B65D 5/02 206/521 |
| 4,580,683 | A | 4/1986 | Gochenour | |
| 4,809,904 | A * | 3/1989 | Yasutaniya | B65D 5/18 206/521 |
| 5,064,114 | A * | 11/1991 | Cravens | B65D 5/3628 206/424 |
| 5,662,420 | A | 9/1997 | Sinda et al. | |
| 6,328,160 | B1 * | 12/2001 | Cooksey | B65D 5/0005 206/224 |
| 6,779,666 | B2 | 8/2004 | Collins | |
| 8,123,035 | B2 | 2/2012 | Won | |
| 8,562,216 | B2 | 10/2013 | Kendall et al. | |
| 10,011,394 | B2 | 7/2018 | Greenwood et al. | |
| 2008/0290144 | A1 * | 11/2008 | Makofsky | B65D 81/107 229/68.1 |
| 2009/0072015 | A1 * | 3/2009 | Drew | B65D 5/2057 229/102 |
| 2018/0290806 | A1 | 10/2018 | Nishigaki et al. | |
| 2018/0305088 | A1 | 10/2018 | Greenwood et al. | |
| 2019/0135495 | A1 | 5/2019 | Greenwood et al. | |

FOREIGN PATENT DOCUMENTS

| | | | | |
|---|---|---|---|---|
| DE | 9311903 | U | 8/1993 | |
| DE | 19617648 | A1 * | 11/1997 | B65D 75/66 |
| ES | 188381 | U | 6/1974 | |
| FR | 2615491 | A1 * | 11/1988 | |
| GB | 102796 | | 12/1916 | |
| GB | 2589333 | A * | 6/2021 | B65D 27/38 |
| JP | S4999619 | U | 8/1974 | |
| JP | S5010619 | U | 2/1975 | |
| JP | H03108640 | U | 11/1991 | |
| JP | 3007594 | U | 2/1995 | |
| JP | 2001199449 | | 7/2001 | |
| JP | 3110361 | U | 6/2005 | |
| JP | 2006312487 | A * | 11/2006 | |
| JP | 3159073 | U | 5/2010 | |
| JP | 2010208310 | A2 | 9/2010 | |
| KR | 101068638 | | 3/2011 | |
| WO | WO-2017024797 | A1 * | 2/2017 | |

OTHER PUBLICATIONS

Machine translation of JP-2006312487-A.*
Machine translation of DE-9200839-U1.*
Machine translation of FR-2615491-A1.*

* cited by examiner

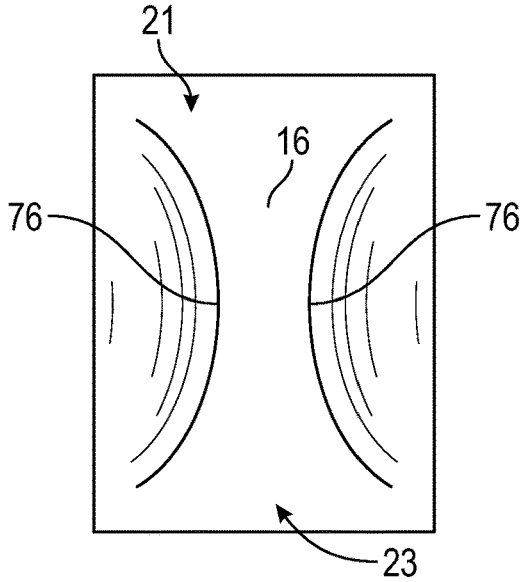
FIG. 12A
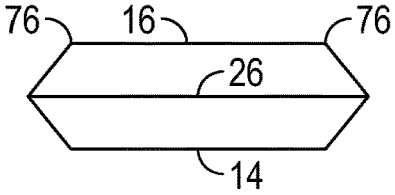
FIG. 12B
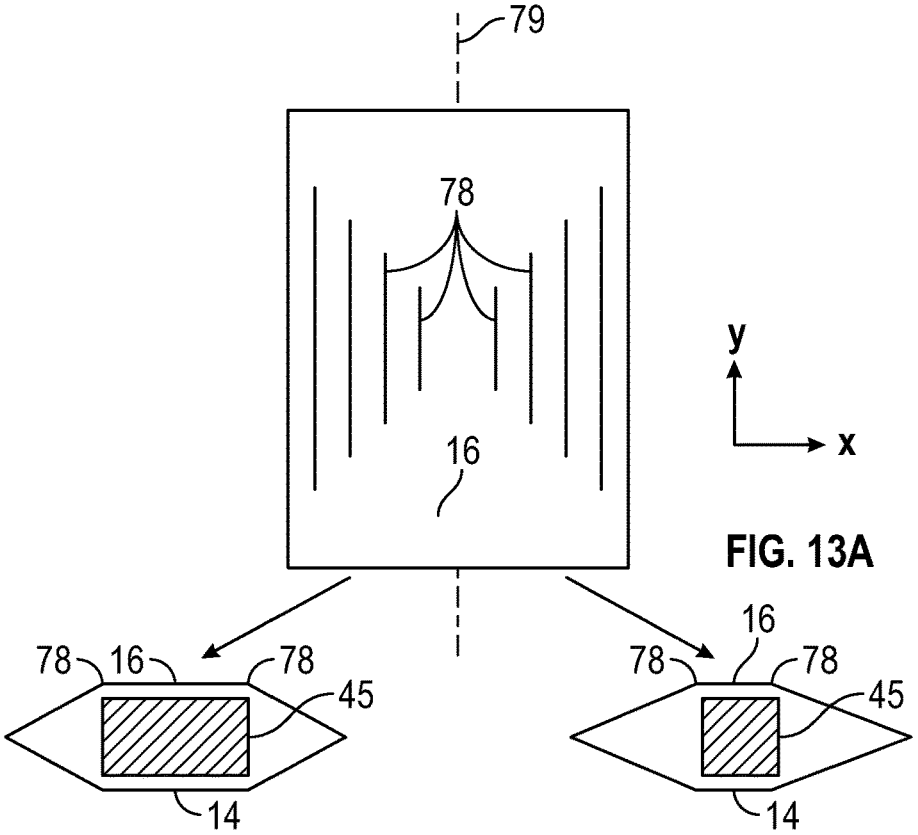
FIG. 13A
FIG. 13B
FIG. 13C

SHIPPING MAILER

CROSS REFERENCE TO RELATED APPLICATIONS

This application claims the benefit of U.S. Provisional Application No. 63/020,517, filed May 5, 2020, and claims the benefit of U.S. Provisional Application No. 62/881,240, filed Jul. 31, 2019. Each of U.S. Provisional Application No. 63/020,517 and U.S. Provisional Application No. 62/881,240 are incorporated herein by reference in their entirety.

FIELD

The disclosure pertains to shipping receptacles or mailers, such as envelopes and the like.

BACKGROUND

Existing soft-sided shipping receptacles such as bubble mailers are space-intensive and correspondingly expensive to ship in bulk to retailers. Additionally, many existing soft-sided shipping mailers are made at least partially if not entirely of polymeric materials such as plastics that are not biodegradable and/or cannot be economically recycled, if at all. Accordingly, there exists a need for improvements to soft-sided shipping mailers such as cushioned or padded envelopes.

SUMMARY

Certain embodiments of the disclosure pertain to shipping receptacles or shipping mailers, such as envelopes and the like. In a representative embodiment, an apparatus comprises a shipping mailer that is expandable between a collapsed state and an expanded state, the shipping mailer comprising, a first wall and a second wall that at least partially define an interior of the shipping mailer. The shipping mailer comprises a closed first end portion and a second end portion comprising an opening sealable by a closure. The shipping mailer further comprises a plurality of corrugations coupled to the first wall in the interior of the shipping mailer, and a plurality of corrugations coupled to the second wall in the interior of the shipping mailer. The corrugations of the first wall and the corrugations of the second wall comprise respective preformed fold lines at the closed first end portion about which the first wall and the second wall are configured to fold when an object is inserted into the shipping mailer to create an end wall extending between the first and second walls at the closed first end portion of the shipping mailer.

In any or all of the disclosed embodiments, the preformed fold lines of the corrugations are curved such that apices of the preformed fold lines are offset from the closed first end portion toward the second end portion.

In any or all of the disclosed embodiments, the preformed fold lines of the corrugations are straight.

In any or all of the disclosed embodiments, the preformed fold lines of the corrugations are angled relative to a direction of the plurality of corrugations of the first wall and of the second wall.

In any or all of the disclosed embodiments, the preformed fold lines are creases or cuts in the corrugations.

In any or all of the disclosed embodiments, the corrugations of the first wall extend in a first direction, the corrugations of the second wall extend in the first direction, and the corrugations of the first wall are configured to receive corrugations of the second wall such that the corrugations of the first and second walls nest together when the shipping mailer is in the collapsed state.

In any or all of the disclosed embodiments, at least the corrugations of the second wall comprise a plurality of second preformed fold lines extending in a second direction between the closed first end portion and the second end portion of the shipping mailer.

In any or all of the disclosed embodiments, at least one of the first and second walls comprises a zone in which the corrugations are crushed.

In any or all of the disclosed embodiments, the shipping mailer further comprises a divider between the first wall and the second wall such that the interior of the shipping mailer comprises multiple compartments.

In any or all of the disclosed embodiments, the closed first end portion comprises a hinge line from which the first and second walls extend, and the preformed fold line of the corrugations of the first wall is on the opposite side of the hinge line from the preformed fold line of the corrugations of the second wall.

In any or all of the disclosed embodiments, the shipping mailer comprises a cellulosic material.

In any or all of the disclosed embodiments, the shipping mailer is plastic-free.

In any or all of the disclosed embodiments, the shipping mailer is configured as an envelope.

In another representative embodiment, a method of making any of the apparatus' described herein comprises applying a corrugated layer to a liner layer, side edge portions of the liner layer extending beyond side edges of the corrugated layer, forming the preformed fold lines in corrugations of the corrugated layer, folding the liner layer and the corrugated layer about a hinge line to form the first wall and the second wall, and sealing the first and second side walls together at the side edge portions of the liner layer to form the shipping mailer.

In another representative embodiment, an apparatus comprises a shipping mailer that is expandable between a collapsed state and an expanded state, the shipping mailer comprising a first wall and a second wall that at least partially define an interior of the shipping mailer. The shipping mailer comprises a closed first end portion and a second end portion comprising an opening sealable by a closure. The shipping mailer further comprises a plurality of corrugations coupled to the first wall in the interior of the shipping mailer, and a plurality of corrugations coupled to the second wall in the interior of the shipping mailer. The corrugations of the first wall and the corrugations of the second wall comprise respective preformed fold lines at the closed first end portion configured such that when an object is inserted into the shipping mailer, the first and second walls move apart and fold about the preformed fold lines such that the closed first end portion expands to accommodate the object.

In any or all of the disclosed embodiments, the preformed fold lines of the corrugations are curved such that apices of the preformed fold lines are offset from the closed first end portion toward the second end portion.

In any or all of the disclosed embodiments, the closed first end portion comprises a hinge line from which the first and second walls extend, and the preformed fold line of the corrugations of the first wall is on the opposite side of the hinge line from the preformed fold line of the corrugations of the second wall.

In another representative embodiment, a method comprises forming a fold line in a bulk cellulosic fiber-based material, separating a portion of the bulk cellulosic fiber-based material to form a shipping mailer blank, folding the shipping mailer blank along the fold line, inserting an object into the folded shipping mailer blank, and sealing edges of the folded shipping mailer blank to enclose the object in a shipping mailer.

In any or all of the disclosed embodiments, the fold line is a hinge line extending between walls of the shipping mailer, and the method further comprises forming a plurality of sinusoidally-extending fold lines in the bulk cellulosic fiber-based material.

In any or all of the disclosed embodiments, the bulk cellulosic fiber-based material comprises paper, paperboard, linerboard, containerboard, card stock, cardboard, kraft paper, single-face corrugated, corrugated board, or any combination thereof.

In another representative embodiment, a method comprises applying a corrugated layer to a liner layer, side edge portions of the liner layer extending beyond side edges of the corrugated layer, forming a first fold line in corrugations of the corrugated layer, forming a second fold line in corrugations of the corrugated layer, folding the liner layer and the corrugated layer about a hinge line extending between the first and second curved fold lines to form two walls, and such that the first and second fold lines are on opposite sides of the hinge line from each other, and sealing the two walls together at the side edge portions of the liner layer to form a shipping mailer.

In another representative embodiment, a method comprises separating a portion of a bulk cellulosic fiber-based material to form a shipping mailer blank, folding the shipping mailer blank along a fold line, inserting an object into the folded shipping mailer blank, and sealing edges of the folded shipping mailer blank to enclose the object in a shipping mailer.

The various innovations described herein can be used separately or in any combination. The foregoing objects, features, and advantages of the disclosed technology will become more apparent from the following detailed description, which proceeds with reference to the accompanying figures.

BRIEF DESCRIPTION OF THE DRAWINGS

FIGS. 12A and 12B illustrate a top plan view and an end view, respectively, of a shipping mailer/envelope with curved, preformed fold lines extending between the closed and open end portions of the shipping mailer/envelope, according to another embodiment.

FIGS. 13A-13C illustrate a top plan view and end views of a shipping mailer/envelope including longitudinally-extending preformed fold lines, according to another embodiment.

DETAILED DESCRIPTION

Figure 1:
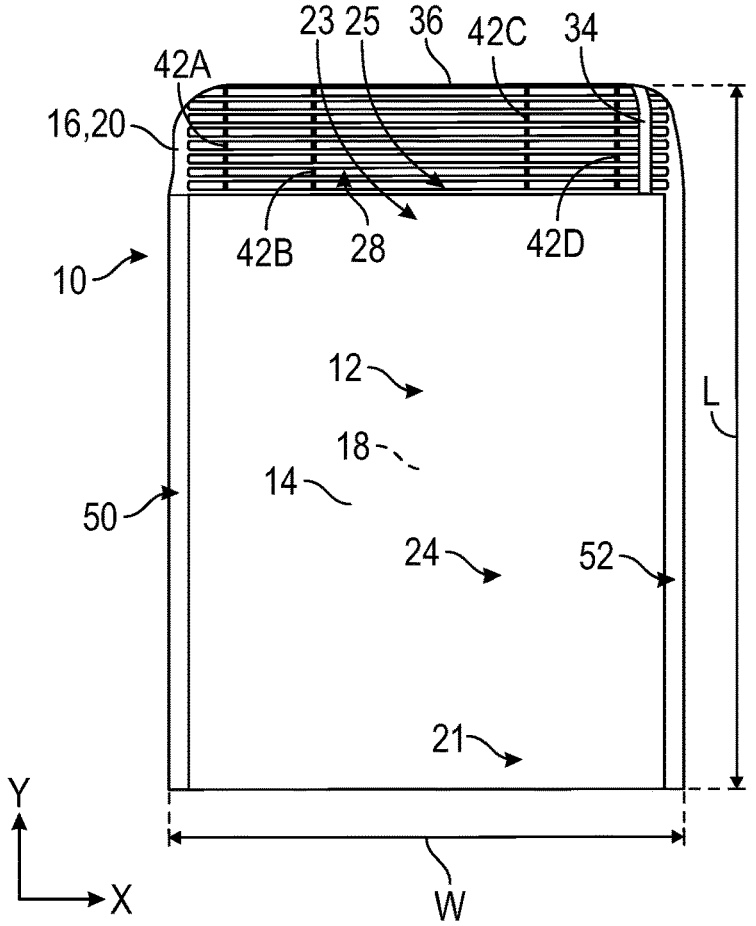
FIGS. 1 and 2 are perspective views of a shipping mailer/envelope, according to one embodiment.

Described herein are embodiments of shipping receptacles, enclosures, or containers, such as envelopes or mailers, which comprise a pouch or pocket defined by a first wall and a second wall. In certain embodiments, the shipping mailer/envelope can include a main body folded about a fold line or hinge line to provide the first and second walls. In certain embodiments, the first and second walls can be separate members or pieces of material joined together to form the main body. The shipping mailer/envelope can have first and second side portions (e.g., parallel or curved side portions) or edges extending between first and second end portions (e.g., parallel or curved end portions) or edges (also referred to as top and bottom end portions or edges) such that the shipping mailer/envelope has a quadrilateral outline, at least in the collapsed state. In certain embodiments, the first end portion can be closed, and the second end portion can comprise an opening. In certain embodiments, the opening can extend along a first axis between the side portions, although other configurations are possible. The side portions can be longer than the end portions, the same length as the end portions, or shorter than the end portions.

The opening of the shipping mailer/envelope can be closable by a closure to seal the interior of the shipping mailer/envelope. In certain embodiments, the closure can be configured as an end closure such as a flap extending from one wall (e.g., the second wall) and configured to be folded over the opening and secured to the other wall in the manner of an envelope. In certain embodiments, the first and second walls can be coupled together, secured, or adhered to form a closure without a flap or other end closure member. In certain embodiments, the first and second walls have the same or similar length, and tape can be applied (e.g., to the exteriors of the walls) to join the walls and close the shipping mailer/envelope. In certain embodiments, the closure can comprise adhesive, fasteners, hot melt adhesive, glue, or other securing means for securing the first wall to the second wall at the closure when the shipping mailer/envelope is in a closed position/state. In certain embodiments, the adhesive can be a co-adhesive. For example, co-adhesive can be located on the inside surface of the flap, and on the corresponding flap-receiving area of the other wall (e.g., the first wall) such that the flap and the flap-receiving area are bonded together upon contact to seal the shipping mailer/envelope. Adhesive covered by a removable, peelable, or releasable liner strip can also be used on the flap and/or on the flap-receiving surface of the first wall.

The first and second walls can include corrugations, flutes, or other cushioning on the inside surfaces of the walls. For example, in certain embodiments the first and/or second wall can comprise single-face corrugated material comprising a plurality of corrugations (e.g., a corrugated layer) on a backing member/layer such as paper or paperboard. In certain embodiments, the corrugations are configured to align or nest such that ridges of the corrugations of one wall are received within valleys of the corrugations of the other wall. In certain embodiments, the corrugations can be configured such that apices of the corrugations on one wall abut apices of the corrugations on the opposite wall and do not nest. In certain embodiments, the corrugations can extend between the side portions (e.g., horizontally) along the first axis. In certain embodiments, the corrugations extend between the end portions (e.g., vertically) along a second axis that is perpendicular to the first axis. The corrugations can extend to the edges of the side portions (or of the end portions), or can be offset inwardly from the edges. In certain embodiments, the corrugations can extend at an angle to the side portions (and/or to the end portions). In certain embodiments, the corrugations or fluting material of the shipping mailer/envelope can be a single continuous or unitary piece of material extending between the end portions, or may comprise multiple discrete pieces attached to a backing/liner layer. In yet other embodiments the shipping mailer/envelope embodiments described herein can be made from single wall corrugated board comprising a corrugated layer sandwiched between first and second backing or liner layers. In yet other embodiments the shipping mailer/envelope can be made from double-wall corrugated board material comprising two corrugated layers sandwiched/faced with three liner layers in an alternating, stacked arrangement.

The corrugations can comprise one or more fold lines comprising creases, folds, cuts, cutouts, scores, buckled areas, weakened areas or lines of weakness (e.g., thinned areas or lines), etc., that facilitate folding the corrugations (and thereby the walls), and/or expanding the pouch to receive an article. The fold lines can be straight or curved. In certain embodiments, the peaks of the corrugations can comprise indentations or deformations axially aligned with each other to form a plurality of straight longitudinal creases. In embodiments in which the corrugations extend along the first axis (e.g., between the side portions), the corrugations can comprise longitudinal fold lines/creases extending along the second axis (e.g., the fold lines/creases can extend between the end portions of the shipping mailer/envelope). The corrugations can comprise multiple longitudinally-extending fold lines/creases (e.g., 2, 3, 4, 5, 6, 7, 8, or more longitudinally-extending fold lines/creases) spaced apart or offset laterally (e.g., along the first axis) from each other between the side portions. The spacing can be equal, unequal, or graduated (e.g., increasing or decreasing from one end of the shipping mailer/envelope to the other), or variable, or in a pattern. The longitudinal fold lines/creases on the first and second walls can be aligned or offset from each other on the inside of the pouch. The longitudinal fold lines/creases can facilitate bending/buckling/folding of the corrugations about axes perpendicular to the corrugations, and the outward expansion of the walls by formation of ridges or apices in the exterior surfaces of the walls to accommodate objects received in the shipping mailer/envelope. The longitudinal fold lines/creases can also extend at an angle to the longitudinal axes of the corrugations.

The corrugations can also include curved fold lines comprising creases, folds, cutouts, scores, indentations, buckled areas, etc. In certain embodiments, the curved fold lines can be located proximate the fold line or hinge line separating the first wall from the second wall. In certain embodiments, each of the first wall and the second wall can comprise a curved fold line in the corrugations. The curved fold line can extend generally between the parallel side portions of the shipping mailer/envelope. In certain embodiments, the curved fold lines can extend from and return to the hinge line from which the first and second walls extend such that an apex of each respective curved fold line is offset from the hinge line (e.g., from the closed first end portion of the shipping mailer/envelope) toward the second end portion of the shipping mailer/envelope. In certain embodiments, the curved fold lines can be semi-circular and can comprise radii. In certain embodiments, the curved fold lines can be described by a portion of a period (e.g., half) of a sine wave. In certain embodiments, the corrugations of each wall can be configured to bend or flex about the curved fold lines to create concave, flat, or convex surfaces at various locations on the shipping mailer/envelope. For example, the walls can flex about the curved fold lines such that a flat or substantially flat bottom or end surface/end wall can be formed in the shipping mailer/envelope extending between the first and second walls at the closed first end portion of the shipping mailer/envelope opposite the opening. This can facilitate the receipt of relatively large objects in the shipping mailer/envelope. In certain embodiments, the distance of the apices of the curved fold lines from the hinge line can determine the width of the flat bottom or end surface (and thereby the thickness of the object that can be accommodated in the shipping mailer/envelope).

In certain embodiments, the shipping mailer/envelope can comprise a singular piece of material, which can include composites of corrugated layer(s) and liner layer(s), folded about a fold line and coupled, adhered, fastened, sealed, etc., along at least the side edges to define the pouch, as described above. In certain embodiments, the edges can be coupled together with fin seals. For example, in certain embodiments, the corrugations can stop short of the edges, allowing portions of each wall (e.g., the backing layer in examples where the shipping mailer/envelope comprises single-face corrugated material) to directly overlap at the edges. Adhesive such as hot melt, glue, etc., can be applied between the overlapping sections of the first and second walls to form the fin seals. In certain embodiments, the fin sealed portions can be folded over and adhered or secured to form a cuff for additional strength. In certain embodiments, the edges can be sealed or coupled together with rolled edge seals in which one edge is folded over the other and secured. In certain embodiments, the edge portions of one or both walls (e.g., side margins of the corrugated layer) can be skived. Adhesives and sealing processes that can be used include bar sealing, cold adhesive sealing, and rotary adhesive sealing, to name a few.

The shipping mailers/envelopes described herein can be made from any of various materials. For example, the mailers and/or constituent layers or components can comprise any of various cellulosic fiber-based materials such as paper, paperboard, linerboard, containerboard, card stock, cardboard, kraft paper, and/or composites of different cellulosic fiber-based materials such as single-face corrugated and/or corrugated board. For example, the shipping mailers/envelopes can comprise a single-face corrugated composite material comprising a first layer configured as a backing layer or a liner layer, and a second layer comprising the flutes or corrugations coupled or adhered to the liner layer. The first and/or second layers can comprise one or more plant-based (e.g., wood-based) cellulosic fiber materials such as paper, paperboard, linerboard, containerboard, card stock, cardboard, and/or kraft paper, to name a few. In certain embodiments, one or both walls of the shipping mailer/envelope can comprise a second liner layer (e.g., a third layer) sandwiching the corrugated layer between the first and second liner layers. The cellulosic fiber materials may be bleached or unbleached, depending upon the particular characteristics desired. In certain embodiments, the liner layer of the shipping mailer/envelope can have a feathered or deckle edge (e.g., in the case of production of the shipping mailer/envelope from butt rolls).

Certain embodiments of the shipping mailers/envelopes disclosed herein are formed substantially (99% or greater) of biodegradable materials. Certain embodiments of the shipping mailers/envelopes disclosed herein are formed completely from biodegradable materials. Certain embodiments are plastic-free, or substantially plastic-free (i.e., less than 1% plastic). Certain embodiments are substantially or completely biodegradable and/or are plastic-free, or substantially plastic-free (i.e., less than 1% plastic), at least at the end of its useful life (e.g., after opening of the sealed shipping mailer/envelope), thereby enabling recycling and/or biodegradation. Certain embodiments of the shipping mailer/envelope are free of or substantially free of polyethylene (PE) and/or other synthetic polymers, which materials are typically found in conventional mailers in the form of liners, membranes, walls, shock-absorbing means such as gas bladders, etc. For example, in certain embodiments at least 90%, 92%, 95%, 97%, 98%, or more of the total mass of the mailer is biodegradable.

In certain embodiments, the corrugations can be crushed, crumpled, rolled, etc. In certain embodiments, portion(s) of the corrugations can be crushed, rolled, etc., to create one or more zones. The crushed corrugations can have different bending or flexural rigidity properties, strength properties, and/or load distribution properties, etc., which can be tailored to particular applications or objects, as described further below. For example, crushed or crumpled flutes/corrugations can aid in opening and/or closing the shipping mailer/envelope and make the body of the shipping mailer/envelope more compliant. In certain embodiments, keeping the flutes/corrugations intact can provide for greater stiffness and/or impact resistance.

The materials and structural features above can contribute to unique and advantageous performance characteristics of one or more embodiments of the shipping mailers/envelopes described herein. For example, physical characteristics related to cushioning properties, load distribution, deformation, impact resistance, and/or flexural rigidity can be tuned for the shipping mailer/envelope as a whole, or at certain locations. Certain of the mailers described herein can also provide performance advantages over existing mailers made from plastic materials, such as bubble mailers.

In certain embodiments, the shipping mailer/envelope can comprise an opener member to facilitate opening the shipping mailer/envelope once it has been closed or sealed for shipment. In certain embodiments, the opener member is a strip, string, or other member embedded, partially embedded, or operably coupled to one or both walls of the shipping mailer/envelope, and configured to be torn through or out of the wall to create an opening. The opener member can extend along the first axis (e.g., parallel to the flutes or parallel to the opening at the second end) or along the second axis (e.g., perpendicular to the flutes). Where the shipping mailer/envelope includes a flap closure, the opener member can extend across the short dimension or width dimension of the flap, and along the wall to which the flap is coupled. The opener member can also extend along the long dimension of the flap. The wall in which the opener member is incorporated can comprise one or more areas of weakness at one or both ends of the opener member, such as one or a series of score lines, knife cuts, perforations, etc., on one or both sides of the opener member to facilitate removing the opener member to open the shipping mailer/envelope. The opener member can also extend along the second axis (e.g., parallel to the sealed side edges) proximate to one of the side edges.

In certain embodiments, the opener member can be situated, disposed, and/or sandwiched between at least two layers of material such that when the opener member is removed, it is pulled through at least one layer of material. For example, the opener member can be laid, positioned, or disposed on a liner layer of the corrugated material such that it is pulled through the liner layer to create an opening in the shipping mailer/envelope. The opener member can also be disposed on the flutes/corrugations such that it is pulled through the flutes and through the liner layer in order to open the shipping mailer/envelope. In certain embodiments, the opener member can be incorporated into the adhesive strip for sealing the flap or other closure. The opener member can be located anywhere on any of the walls of the shipping mailer/envelope, in any spatial relationship with the flap or closure.

In certain embodiments, the shipping mailer/envelope can comprise any of various coatings on the interior and/or exterior surfaces to impart particular properties. For example, the shipping mailer/envelope can include anti-abrasive coatings (e.g., polytetrafluorethylene (PTFE)), hydrophobic or water-repellant coatings, and/or antistatic coatings to reduce the buildup of electric charge. Any of the coatings described herein can be combined in various layers and/or mixtures according to the particular properties sought, or as specified for a particular application.

In certain embodiments, the shipping mailers/envelopes described herein can be made by applying (e.g., by adhesive) a corrugated layer to a liner layer. In certain embodiments, the width dimension of the corrugated layer can be less than the width dimension of the liner layer such that side edge portions of the liner layer extend beyond the side edges of the corrugated layer. Various fold lines, such as creases, indentations, scores, etc., can be formed in the corrugated layer. For example, the curved fold lines described in detail herein can be formed in the corrugations, along with a primary fold line or hinge line, which can extend straight across the width of the composite corrugated layer and liner layer construction. In certain embodiments, the hinge line can extend between the curved fold lines, and apices of the curved fold lines can be offset from the hinge line in opposite directions (at least before the material is folded about the hinge line to form the walls of the shipping mailer/envelope). If the shipping mailer/envelope is being manufactured from a bulk supply of material, sections of the bulk supply can be separated at specified lengths, and the resulting sections can be folded about the respective hinge lines and sealed together at the edge portions of the liner using any of the seal configurations described herein.

One or more of the shipping mailer/envelope embodiments described herein can provide a number of significant advantages over existing envelopes and mailers. For example, in embodiments in which the corrugations are configured to nest in the collapsed state, the thickness of the unstuffed shipping mailer/envelope can be reduced by more than 40% as compared to existing mailers, without sacrificing cushioning material thickness or cushioning properties. For example, in particular embodiments the shipping mailer/envelope described herein can have a thickness of 127 mils (0.127 inch) in the collapsed or unstuffed state, as compared to 216 mils (0.216 inch) for certain existing bubble mailers, where the total thickness of the bubble mailers is equal to the full thickness of both walls including cushioning. This can result in significant space and shipping cost savings when delivering unstuffed shipping mailer/envelope to retailers in bulk.

Additionally, in embodiments in which the backing layer and the corrugations of the walls comprise cellulosic materials, the shipping mailer/envelope are completely or substantially recyclable and/or biodegradable, significantly reducing the environmental impact of the shipping mailer/envelope. As used herein, cellulosic or paper material, especially such material treated with water-resistant coatings or additives, is "recyclable" if it can be processed into new paper/paperboard/cardboard/corrugated using the process defined in the Fibre Box Association's Voluntary Standard for Repulping and Recycling Corrugated Fiberboard Treated to Improve its Performance in the Presence of Water and Water Vapor. As used herein, "biodegradable" means that the referenced article can be substantially (at least 95%) or completely decomposed by microorganisms (e.g., bacteria, fungi, etc.) or other natural processes in one year or less from the time the article is placed in the trash, a landfill or the like. Certain of the disclosed shipping mailer/envelope can also be produced using certain percentages by weight of renewable plant-based fiber materials and/or recycled materials. Certain of the disclosed shipping mailer/envelope embodiments can also provide reduced carbon emissions over the product's life cycle as compared to existing mailers.

One or more of the shipping mailer/envelope embodiments described herein can also provide advantages related to waste reduction, such as at mills. For example, in certain applications a roll or core of cellulosic fiber-based material (e.g., single-face corrugated) may need to be reduced in size or trimmed. In certain embodiments, material may be trimmed from one or both outside edges of the bulk material, depending upon the particular size and/or performance characteristics specified. The excess or trimmed material, which may be wound or spooled onto rolls known as "butt rolls," and may be of non-standard size and/or outside of performance specifications for the material of the primary roll. Often, this material has limited usefulness, and may be re-pulped. However, the size and performance characteristics of such extra material can be suitable for the production of shipping mailers/envelopes as described herein, reducing the amount of material that must be re-pulped.

Embodiments of the shipping mailers/envelopes described herein can also have any size and/or aspect ratio, depending upon the particular application. For example, the longitudinal dimension between the closed end portion and the open end portion can be longer than width of the length of the shipping mailer/envelope, or vice versa. Particular embodiments of shipping mailers/envelopes including one or more of the features above are described below.

First Representative Embodiment

The following description pertains to embodiments of a shipping mailer/envelope or receptacle, which comprises a pouch or pocket defined by a first wall and a second wall. The first and second walls can include corrugations, flutes, or other cushioning means on the inside surfaces of the walls. The corrugations can be configured to align or nest such that the ridges of the corrugations of one wall are received within the valleys of the corrugations of the other wall. The corrugations can comprise one or more creases, folds, cutouts, areas or lines of weakness, buckled areas, etc., which can facilitate folding the corrugations (and thereby the walls), and/or expanding the pouch to receive an article. The shipping mailer/envelope can be closable by a flap integrally formed in one wall. One wall can comprise an opening member. In certain embodiments, the opening member can be a tear strip configured to extend across the short dimension or width dimension of the flap, and along the wall to which the flap is coupled.

Figure 2:
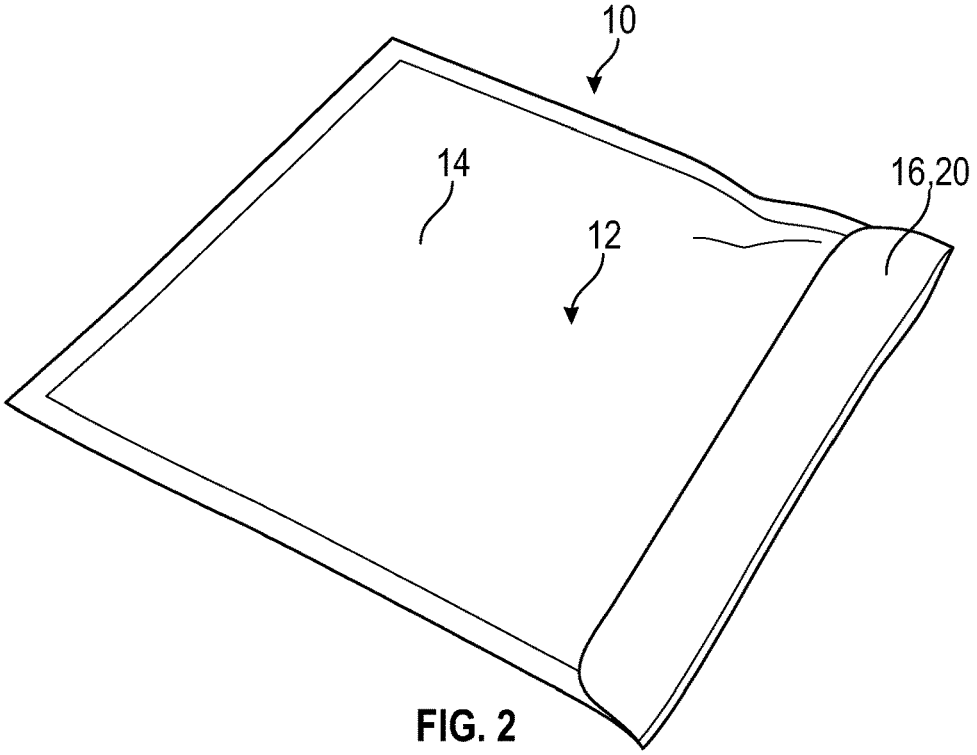

FIGS. 1 and 2 illustrate a shipping mailer/envelope 10, according to one embodiment. The shipping mailer/envelope 10 can comprise a main body 12 folded to form a first wall 14 and a second wall 16. The first and second walls 14, 16 can at least partially define an interior 18 of the shipping mailer/envelope (also referred to as a pouch or a pocket). The shipping mailer/envelope 10 can have a closed first end portion 21 and a second end portion 23 comprising an opening 25. The opening 25 of the shipping mailer/envelope can be closable by a sealing member configured as a flap 20 extending from the second wall 16 in the manner of an envelope. The shipping mailer/envelope 10 can further comprise a first side portion 50 and a second side portion 52 extending between the first end portion 21 and the second end portion 23.

Figure 3:
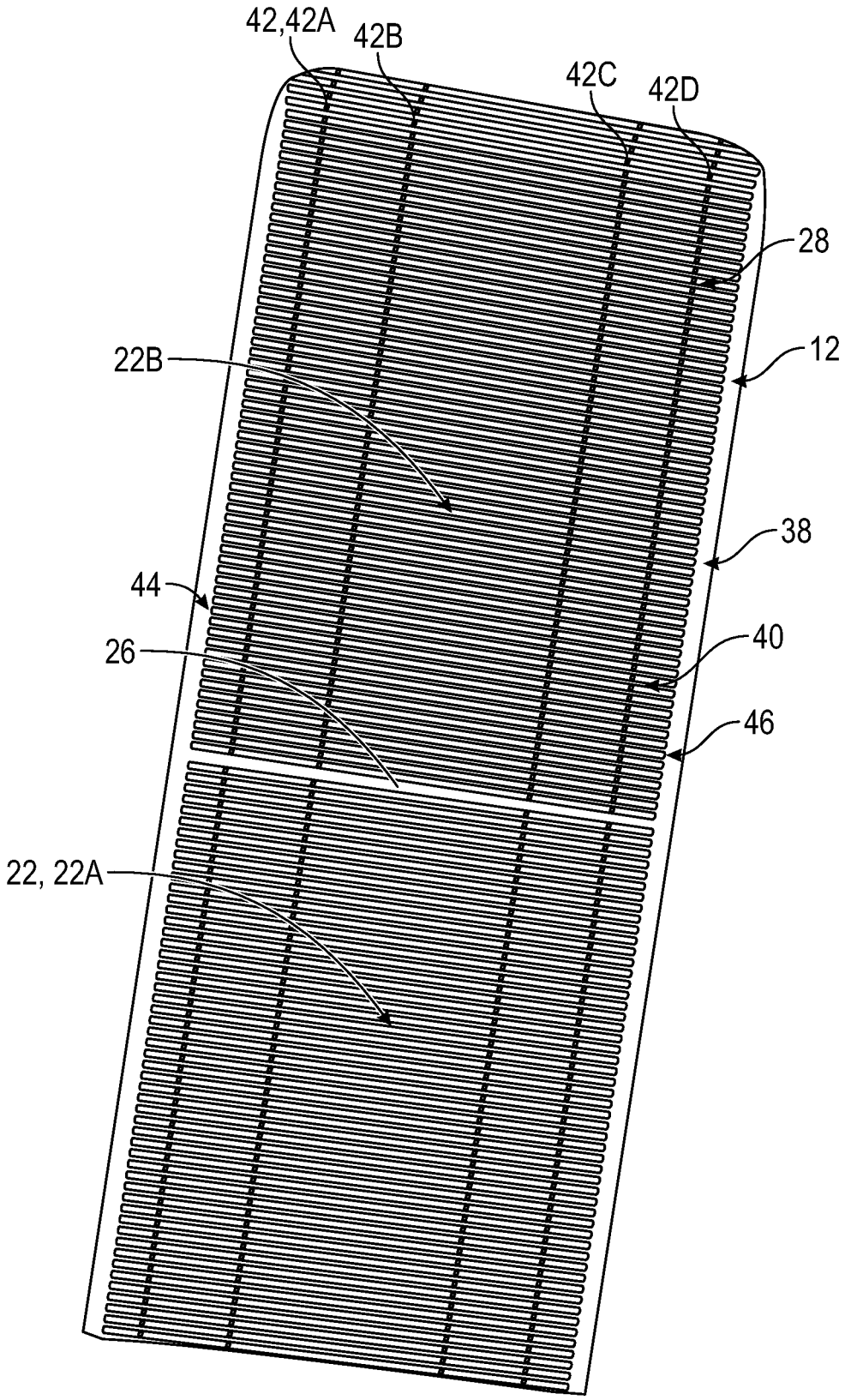
FIG. 3 is a top plan view of the shipping mailer/envelope of FIG. 1 in an unfolded state.

FIG. 3 illustrates the shipping mailer/envelope 10 in an unfolded state. The main body 12 can comprise a first surface 22 (e.g., an interior surface when the shipping mailer/envelope is assembled) and a second surface 24 (FIG. 1) (e.g., an exterior surface). The first and second walls of the shipping mailer/envelope can be formed by folding the main body 12 about a hinge line 26 (also referred to as fold line 26). The fold line 26 can divide the first surface 22 into a portion 22A and a portion 22B on opposite sides of the fold line 26 (e.g., the hinge line extends between the walls 14 and 16). When the main body 12 is folded about the fold line 26, the portion 22A can become an interior surface of the first wall 14, and the portion 22B can become an interior surface of the second wall 16.

Figure 4:
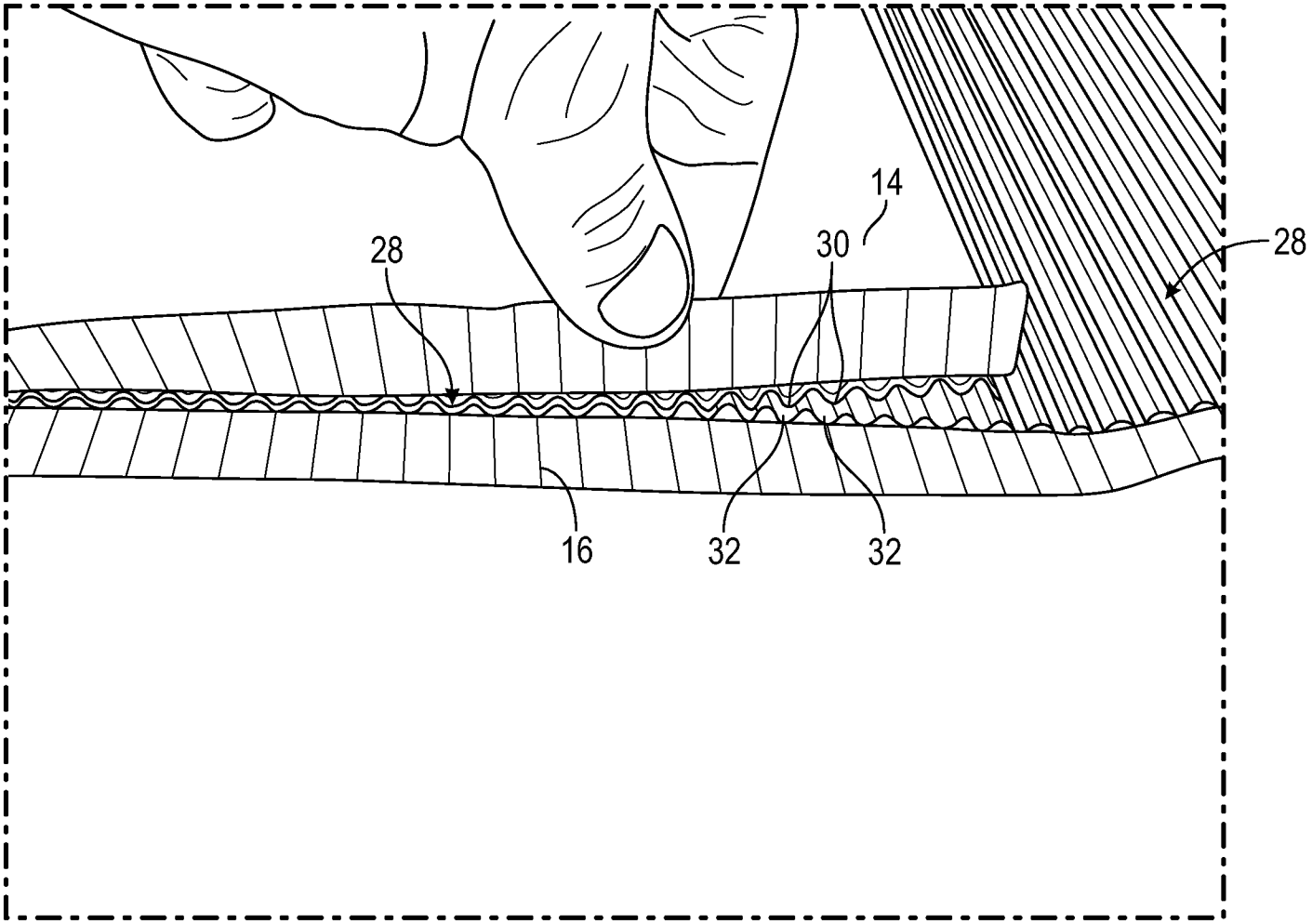
FIG. 4 is a magnified view of one edge of the shipping mailer/envelope of FIG. 1.

The first surface 22 of the main body can comprise a plurality of ridges, flutes, or corrugations 28. In the illustrated embodiment the corrugations extend along the x-axis (e.g., a first axis) across a width dimension W (FIG. 1) of the shipping mailer/envelope, although the corrugations can also extend along the length dimension L (e.g., along the y-axis), or at an angle to the length and width dimensions. With reference to FIG. 4, the corrugations 28 of the first wall 14 can be offset from the corrugations 28 of the second wall 16 along the length dimension (y-axis) of the shipping mailer/envelope 10 such that the corrugations of the first wall are configured to nest or nestle with the corrugations of the second wall 16. For example, in the illustrated configuration the peaks 30 of the corrugations of the first wall 14 are received in the valleys 32 of the corrugations 28 of the second wall 16, although the relationship may be reversed.

Returning to FIG. 3, in certain embodiments the main body 12 can be configured as a sheet of single-face corrugated material comprising a first layer 38 (also referred to as a main layer, a backing layer, or a liner layer), and a second layer configured as a fluted layer or a corrugated layer 40 and comprising the corrugations 28. In certain embodiments, the corrugated layer 40 can be adhered or coupled to the first layer 38. In the illustrated embodiment, the corrugations 28 can be offset inwardly from the edges 44, 46 of the main body to allow the edges to be coupled or adhered together to form the shipping mailer/envelope.

Referring again to FIG. 1, the main body 12 can also comprise an opener member configured as a tear string or strip 34. The tear strip 34 can extend from a free edge 36 of the flap across the width of the flap 20, and along at least a portion of the length of the second wall 16. The tear strip 34 can be disposed along the interior surface of the second wall 16, and/or can be embedded in or integrally formed with the second wall 16. In certain embodiments, the tear strip 34 can be a member or strip comprising a yield strength greater than the yield strength of the second wall 16 such that the tear strip can be used to controllably open, tear, or rip an access into the second wall to access the interior 18 of the shipping mailer/envelope. In other embodiments, the tear strip can be incorporated into the first wall or the second wall, and can extend in the direction of the flutes or across the flutes, and/or can extend longitudinally in the direction of the length L in FIG. 1, or in the direction of the width W. For example, in certain embodiments the tear strip can be incorporated into the flap 20 as part of a co-adhesive closure and can extend in a direction across the width of the flap. The tear strip may also extend across the width of the second wall 16 on the other side of the mailer from the flap 20 when the flap is in the closed position.

Referring again to FIG. 3, in the illustrated embodiment the corrugations 28 can comprise preformed fold lines 42 extending lengthwise along the main body 12 and across or perpendicular to the axes of the corrugations 28. In other embodiments, the fold lines can extend at an angle to the axes of the corrugations, such as diagonally from one corner of the respective first or second wall to the opposite corner. In certain embodiments, the fold lines 42 can extend across a portion of the length of the main body 12, such as one of the walls 14 or 16, or portions of one or both walls.

In the illustrated embodiment, the main body 12 can comprise four fold lines 42 arranged in groups of two, with fold lines 42A and 42B offset inwardly from the edge 44, and fold lines 42C and 42D offset inwardly from the other edge 46, although the main body can comprise any number of fold lines arranged in any configuration. In other embodiments, the wall 14 or the wall 16 may comprise fold lines, while the other wall is free of fold lines, depending upon the particular characteristics desired.

In certain embodiments, the fold lines 42 can be configured as creases formed in the ridges of the corrugations 28. In certain embodiments, the fold lines 42 can be openings, gaps, or cutouts in the corrugations aligned along an axis.

In certain embodiments the shipping mailer/envelope 10, including the first layer 38 and the corrugations 28, can be formed from cellulosic materials such as paper, paperboard, cardboard, etc. In certain embodiments, the shipping mailer/envelope 10 can comprise a composite of cellulosic and polymeric materials.

Prior to use, the shipping mailer/envelope 10 can be in a first collapsed state in which the corrugations on the interior surfaces of the walls 14 and 16 are nested to reduce a thickness dimension of the shipping mailer/envelope. In use, an article to be shipped can be inserted into the interior 18 of the shipping mailer/envelope 10 through the opening 25, and the corrugations of the two walls can be separated. In this manner, the full height of each set of corrugations can provide cushioning to the article. The walls 14 and 16 can fold about the fold lines 42A-42D to accommodate the article such that the shipping mailer/envelope expands to an expanded state. The flap 20 can be folded onto the first wall 14 and secured, for example, by an adhesive layer 48 (e.g., a co-adhesive, or a peel-off pressure-sensitive sealing tape) on the outer surface of the first wall and/or on the flap itself.

Figure 5:
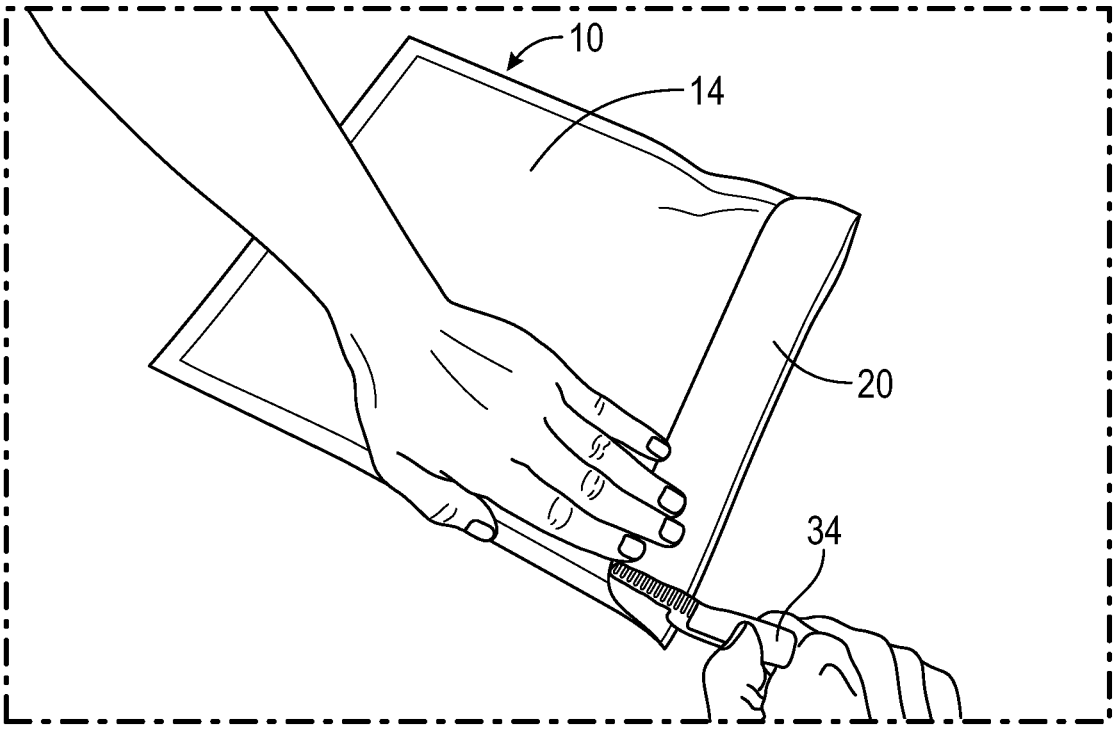
FIGS. 5 and 6 are perspective views illustrating a representative method of opening of the shipping mailer/envelope of FIG. 1.
Figure 6:
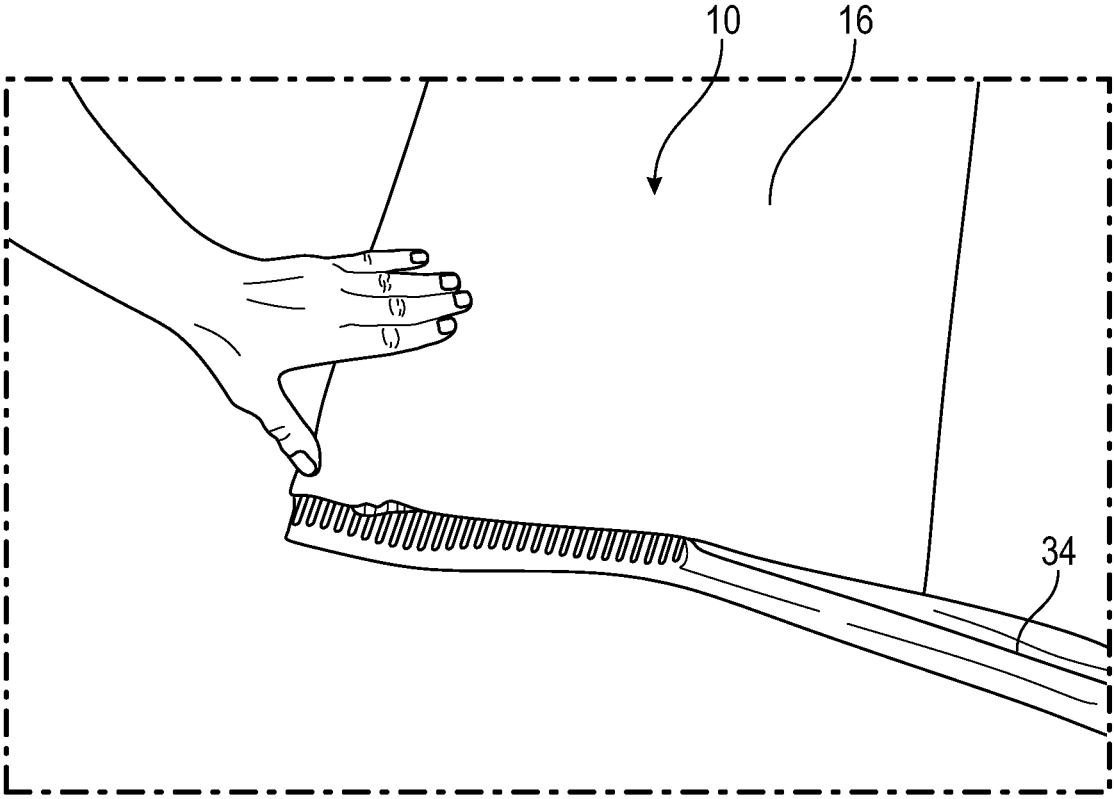

Referring to FIGS. 5 and 6, to open the shipping mailer/envelope, a user can grip the tear strip 34 and, beginning at the edge 36 of the flap 20, pull the tear strip across the width of the flap toward the opposite edge of the flap, and along the second wall 16. The tear strip 34 can be configured to produce an opening in the second wall along a predetermined path to allow access to the interior 18. In the illustrated embodiment, the tear strip 34 is offset inwardly from the edge 46, but can be located at any location across the width of the main body. In certain embodiments, the location of the start of the tear strip can be indicated with a tab, a logo, or other indicia. In other embodiments, the tear strip 34 can extend in the same direction as the corrugations 28.

The shipping mailer/envelope embodiments described above, and any of the other embodiments described herein, can be produced using an in-line, streamlined manufacturing process. For example, a continuous sheet of liner material such as a liner layer (e.g., the first layer 38 of FIG. 3) can be fed into production equipment. A corrugated layer (e.g., the layer 40) can be formed and/or applied to the liner layer to form single-face corrugated sheet stock configured similarly to the main body 12. In certain embodiments, the liner layer can be configured such that edge portions of the liner layer extend beyond the edges of the corrugated layer. The fold line/hinge line 26 can be formed, for example, by indenting, creasing, crushing, skiving, cutting, or any other method described herein for forming fold lines. The tear strip 34 may be applied to the corrugations, and the fold lines 42A-42D can be formed in-line without requiring that the production equipment be stopped, or that the sheet stock be removed from the equipment. The resulting single-face corrugated sheet stock can be cut at a selected length, and folded along the fold line 26 to form the first and second walls 14 and 16, and such that the corrugations 28 on the walls nest. The edges of the walls 14 and 16 can be secured together to form the shipping mailer/envelope 10. In certain embodiments, the single-face corrugated sheet stock formed by applying the corrugated layer to the liner layer can be cut or trimmed along the edges, and the cut edge sections can be formed into butt rolls which can be used to form any of the shipping mailer/envelopes described herein.

Second Representative Embodiment

Figure 7:
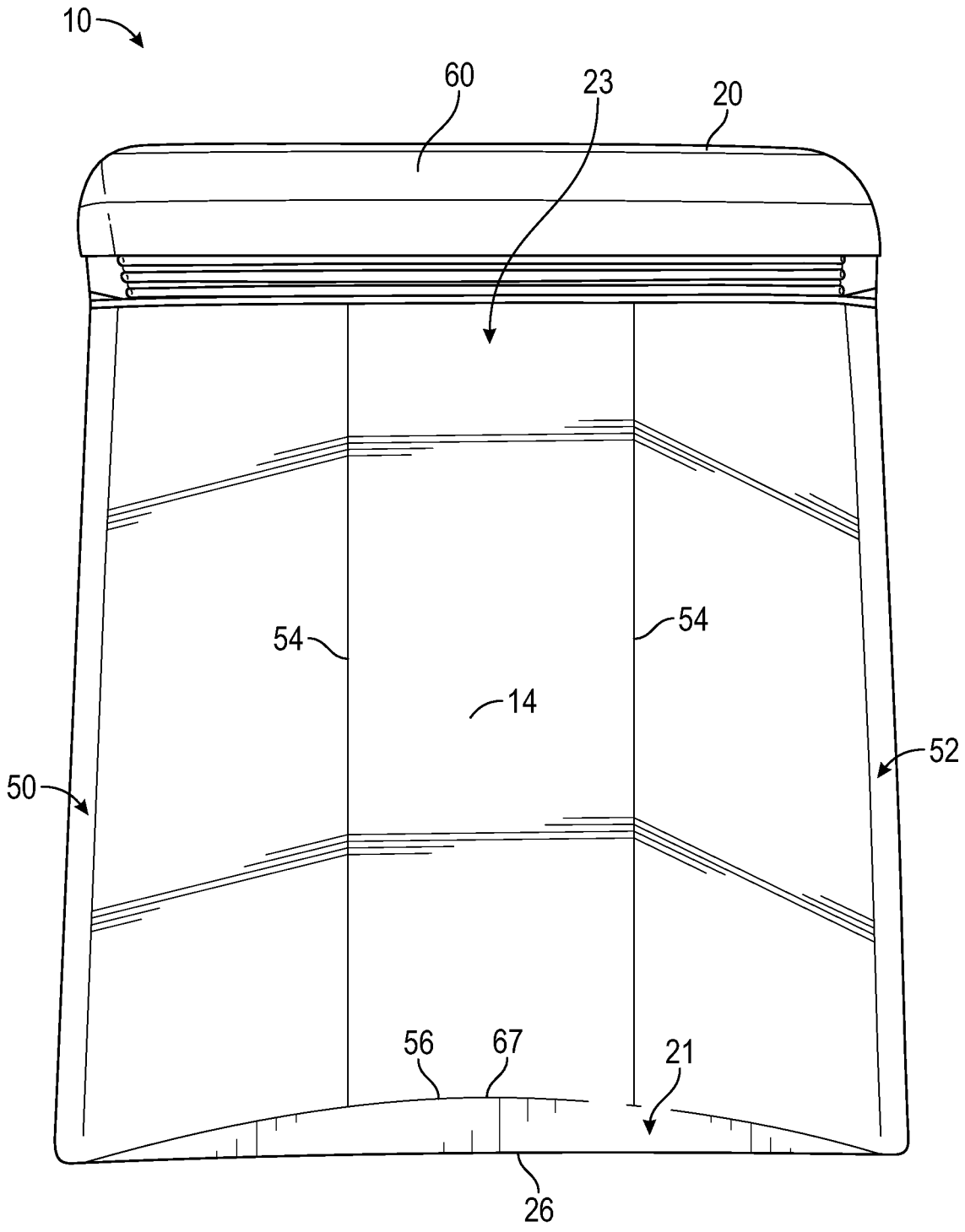
FIG. 7 is a plan view of the rear face of a shipping mailer/envelope, according to another embodiment.
Figure 8:
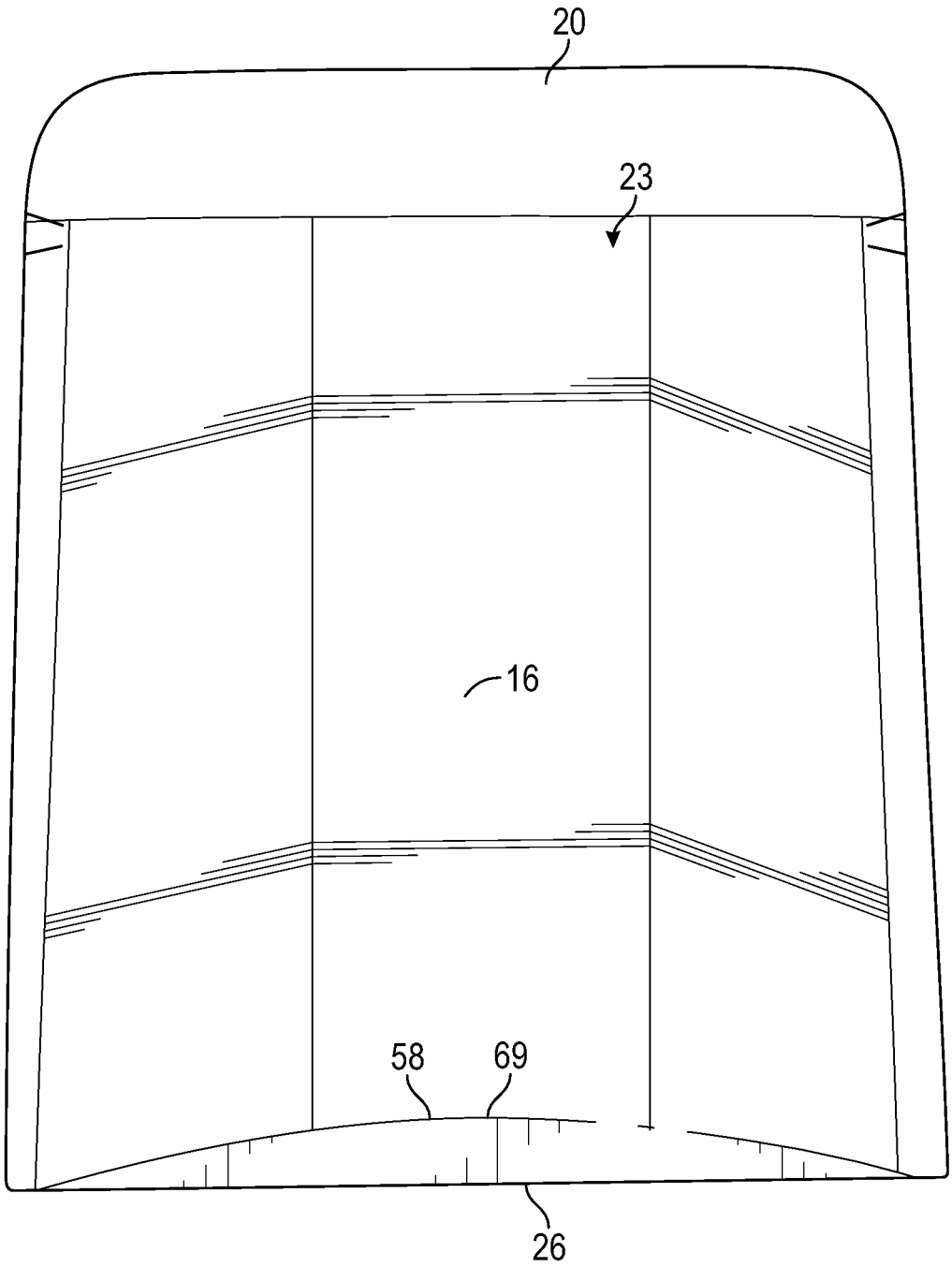
FIG. 8 is a plan view of the front face of the shipping mailer/envelope of FIG. 7.

FIGS. 7-14 illustrate another embodiment of the shipping mailer/envelope 10. FIG. 7 illustrates a plan view of a first side or rear face of the shipping mailer/envelope 10 including the first wall 14 and fin-sealed edge or side portions 50 and 52. One or more liner strips 60 are disposed over adhesive on the flap 20. Straight or vertical fold lines 54 extend between the end portions 21 and 23. The shipping mailer/envelope includes a preformed, curved fold line 56 extending from proximate the corners of the end portion 21 across the width of the shipping mailer/envelope. The fold line 56 can extend from the primary fold line/hinge line 26 and curve upwardly such that the apex 67 of the fold line 56 is offset from the closed first end portion 21 and from the hinge line 26 toward the second end portion 23. A corresponding preformed fold line 58 can be seen on the second wall 16 in FIG. 8 (e.g., on the front face) with its apex 69 also offset from the hinge line 26 toward the second end portion 23.

Figure 9:
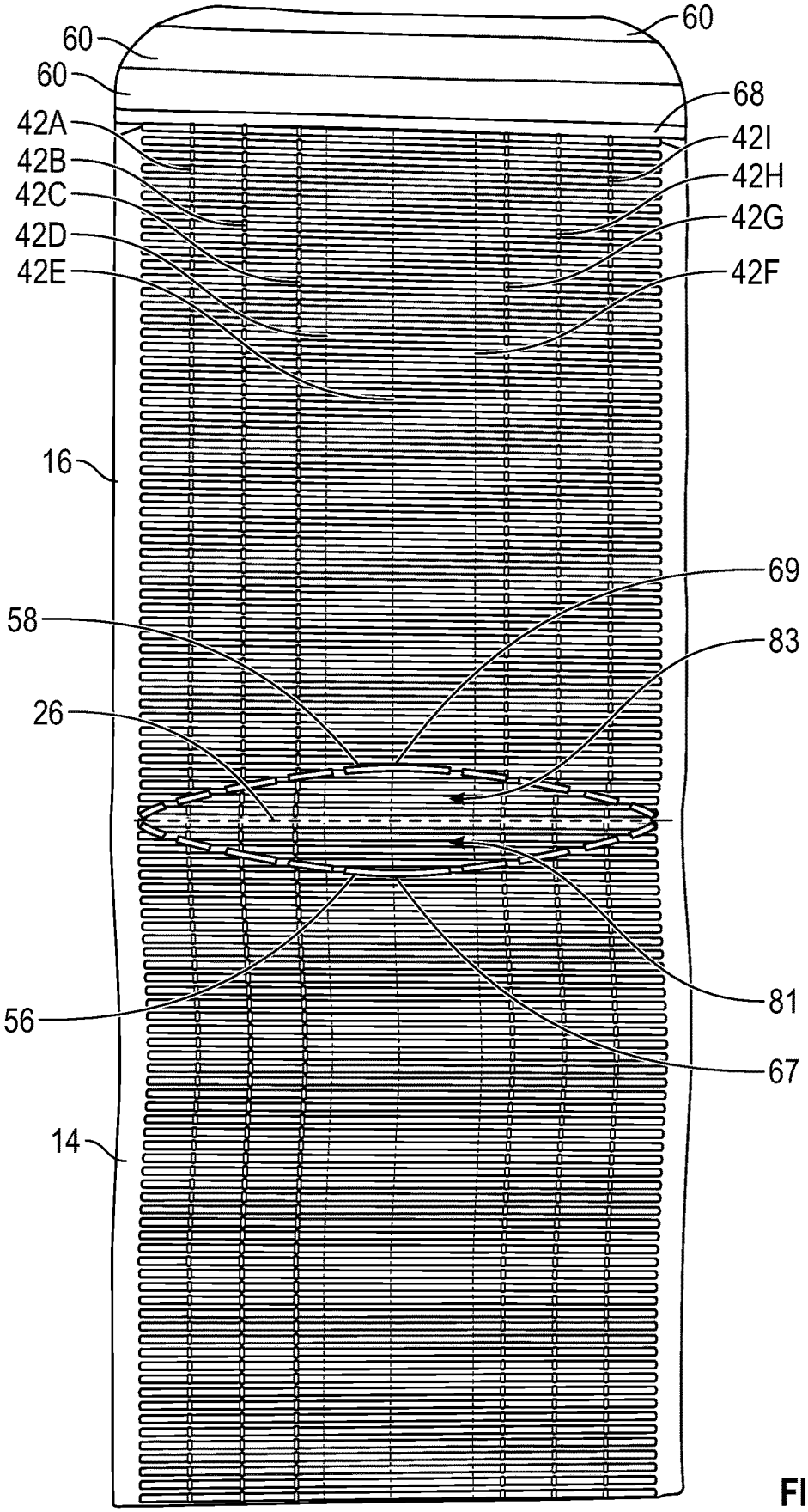
FIG. 9 is a top plan view of the shipping mailer/envelope of FIG. 7 in a laid-flat configuration.
Figure 10:
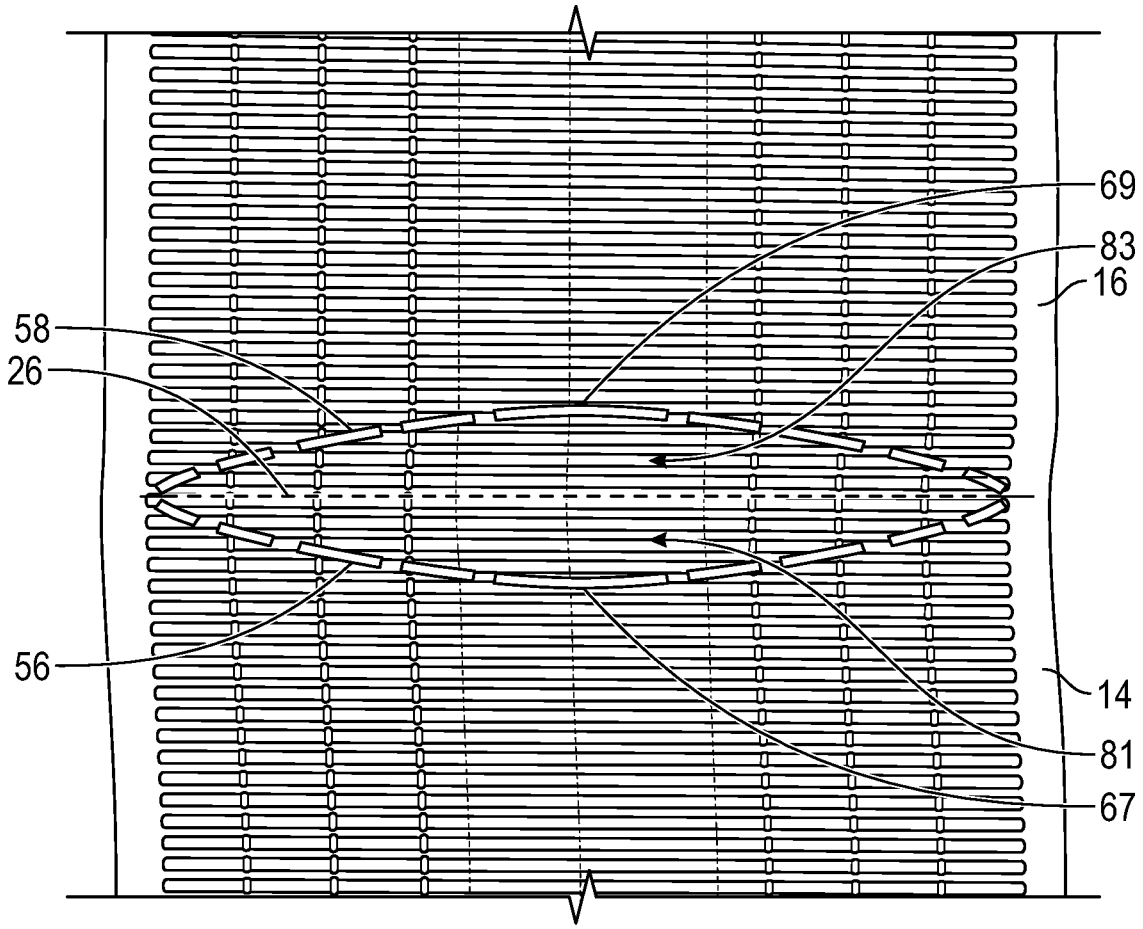
FIG. 10 is a magnified view of the central portion of the shipping mailer/envelope of FIG. 7 illustrating the preformed fold lines at the closed end of the shipping mailer/envelope.

FIG. 9 illustrates the shipping mailer/envelope 10 in an unfolded, laid-flat state with the interior flutes exposed and showing a plurality of preformed fold lines configured as longitudinal scores/creases 42A-42I (six in the illustrated configuration 42A-42C and 42G-42I, and optionally with three additional creases 42D-42F in the center). The curved transverse scores/creases/fold lines 56 and 58 are also illustrated. Any or all of the fold lines can be knife cuts in the corrugations or flutes, or portions of the flutes that have been crushed, creased, buckled, or indented, or can be lines of weakness about which the wall is configured to bend or fold. FIG. 10 is a magnified view of the primary fold line/hinge line 26 and the curved transverse score lines/creases/fold lines 56, 58.

Figure 27:
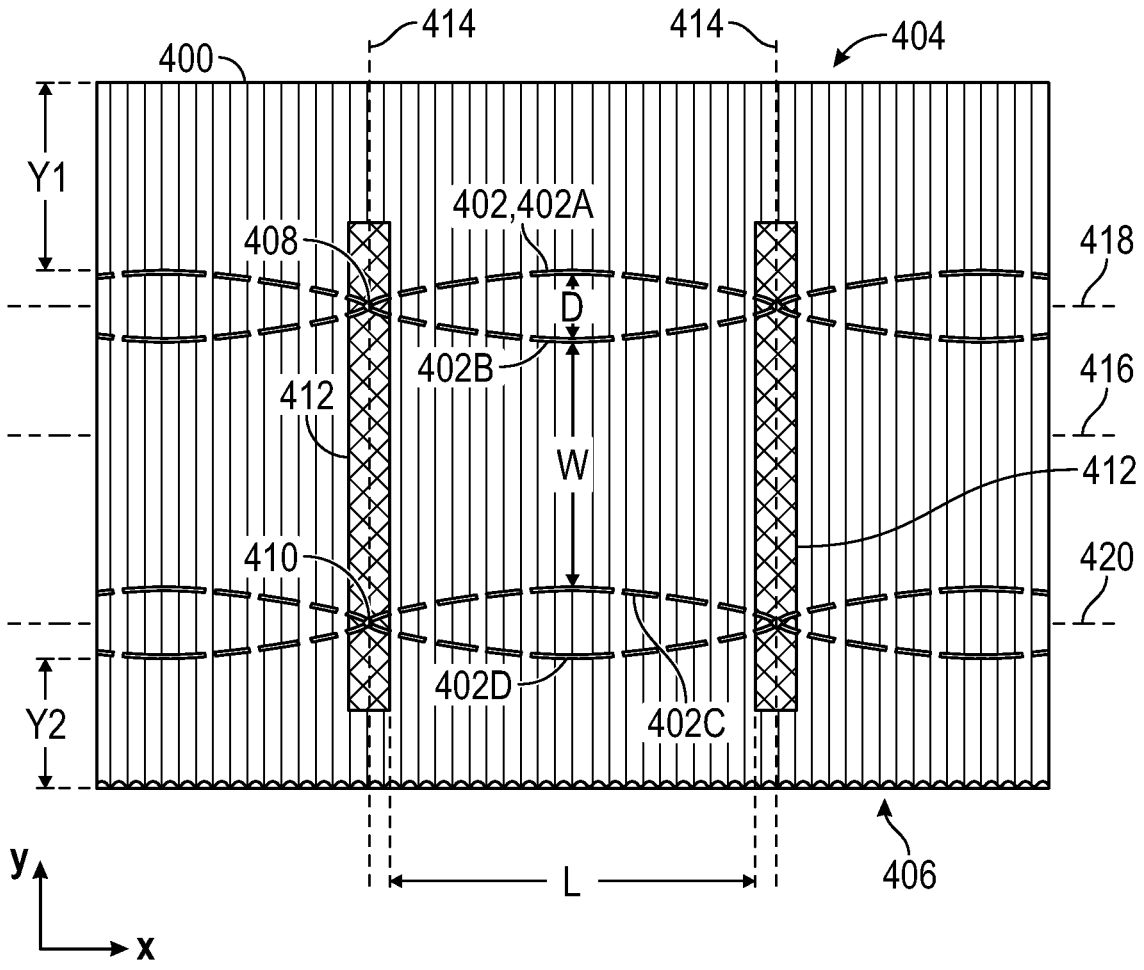
FIG. 27 is a top plan view of a portion of a feedstock material configured for forming shipping mailers/envelopes in a continuous process, according to one embodiment.

Referring to FIGS. 9 and 10, the curved fold lines 56 and 58 can be curved or semi-circular, and in certain embodiments can be described by a portion of a period (e.g., half) of a sine wave (see, e.g., FIG. 27). In certain embodiments, the corrugations of each wall can be configured to bend or flex about the curved fold lines 56 and 58 to create a concave, flat, or convex end wall at the closed end portion 21 extending between the main walls 14 and 16 of the shipping mailer/envelope. For example, a portion 81 of the wall 14 defined between the hinge line 26 and the fold line 56 can be configured to pivot or change orientation about the fold line 56. A portion 83 of the wall 16 defined between the hinge line 26 and the fold line 58 can be configured to pivot about the fold line 58 in a similar manner. In certain embodiments, the pivoted portions 81 and 83 of the respective walls 14, 16 can form an end wall 62 when the shipping mailer/envelope is stuffed, as shown in FIGS. 11C and 14-16.

In certain embodiments, the distance of the apices 67 and 69 of the respective curved fold lines 56 and 58 from the hinge line 26 can determine the width of the flat bottom or end surface, and thereby the thickness of the object that can be accommodated in the shipping mailer/envelope. When the shipping mailer/envelope is stuffed, the walls 14, 16 can also bend or flex about one or more pairs of the fold lines 42A-42I, depending on the object's size, resulting in the vertical lines 54 in the exterior of the walls 14 and 16 shown in FIGS. 7 and 8. The curved fold lines 56, 58 and/or the longitudinal fold lines 42A-42I alone, or in various combinations, can facilitate the receipt of relatively large objects in the shipping mailer/envelope. In certain embodiments, the curved fold lines 56 and 58, along with the longitudinal fold lines 42A-42I can be formed in the corrugated layer 40 in an in-line process as described above.

Figure 11A:
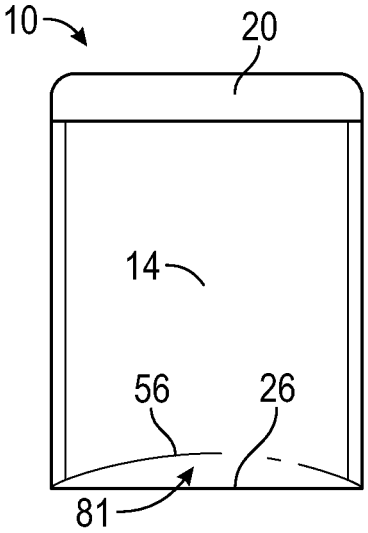
FIGS. 11A-11C illustrate various views of a shipping mailer/envelope with curved fold lines at the closed end portion in the unstuffed and stuffed states.
Figure 11D:
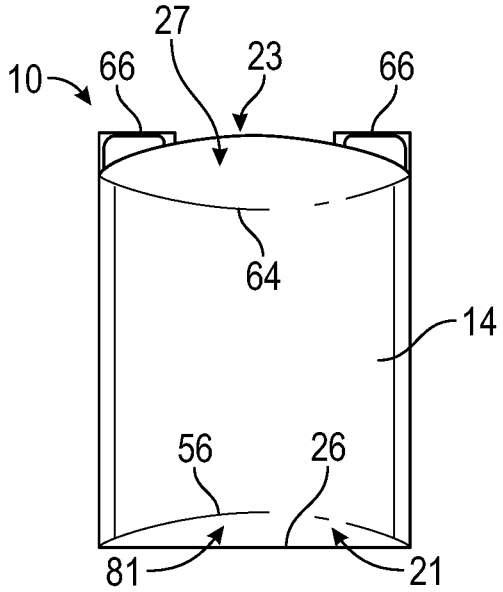
FIGS. 11D-11F illustrate various views of a shipping mailer/envelope with curved, preformed fold lines at the closed end portion and the open end portion in the unstuffed and stuffed states.
Figure 11B:
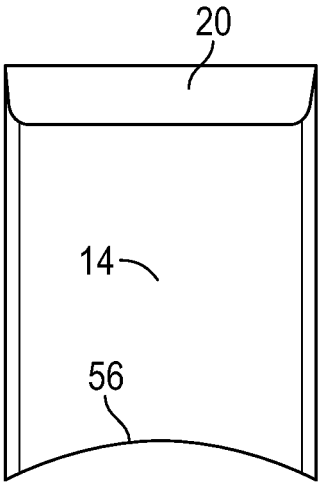
Figure 11E:
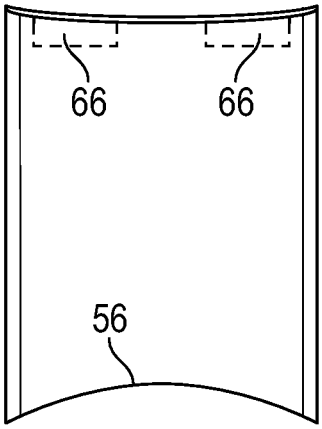
Figure 11C:
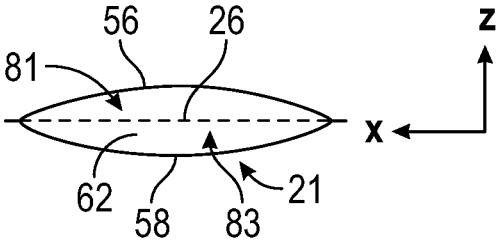

FIGS. 11A-11F illustrate different shapes/configurations of the curved transverse scores/creases/fold lines 56 and 58 and the resulting end wall when the shipping mailer/envelope is stuffed and unstuffed. In FIG. 11A, the shipping mailer/envelope includes curved fold lines along the bottom edge proximate the fold line 26 similar to the embodiment of FIG. 9. FIG. 11B is a plan view illustrating the shipping mailer/envelope in a stuffed state with the flap closed, in which the wall portion 81 has pivoted out of view. FIG. 11C is an elevational view looking at the closed end portion 21. FIG. 11C illustrates the end surface or end wall 62 formed from the corresponding portions 81 and 83 of the first and second walls 14, 16 when the walls are folded about the curved fold lines 56 and 58. In the expanded state, the end wall 62 can extend between the walls 14 and 16, and least portions of the end wall 62 can be perpendicular, or substantially perpendicular, to the walls 14 and 16.

In certain embodiments, as an object is inserted into the shipping mailer/envelope and the walls 14 and 16 are separated as the shipping mailer/envelope expands, the walls 14 and 16 can be configured to automatically fold, bend, or deflect about the respective fold lines 56 and 58 to form one or more surfaces such as the end wall 62 at the closed end portion 21. Thus, as the walls 14 and 16 move apart, for example, along the z-axis in FIG. 11C, the closed end portion 21 can expand, lengthen, or increase in thickness along the z-axis perpendicular, or substantially perpendicular, to the walls 14, 16. The shipping mailer/envelope may also foreshorten as the portions of the walls between the center fold line 26 and the respective fold lines 56 and 58 pivot or change orientation to form end surface(s) such as the end wall 62. In the illustrated embodiment, the greatest foreshortening can occur along the longitudinal or central axis of the shipping mailer/envelope passing through the apices 67 and 69.

Figure 11F:
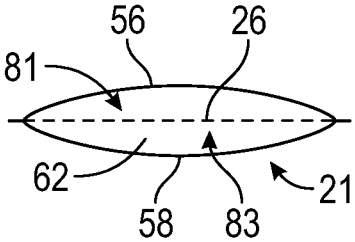

In FIGS. 11D-11F the shipping mailer/envelope 10 also includes curved score lines/fold lines 64 at the opposite end 23 of the shipping mailer/envelope proximate the opening, and the closure comprises two laterally spaced apart flaps 66 (although the closure may also comprise a single flap similar to the flap 20, or any other closure described herein). In the illustrated embodiment, the fold line 64 can define a portion 27 of the wall 14. In certain embodiments, the shipping mailer/envelope can be closed by folding the portion 27 of the wall 14 (or a corresponding portion of the wall 16) inwardly along the fold line 64. A corresponding portion of the opposite wall (e.g., the wall 16) can be folded in a similar manner along its fold line such that the folded portions of both walls overlap and create an end wall at the end portion 23 that extends between the walls 14 and 16 similar to the end wall 62. The flaps 66 can then be secured to the wall 14 to close the shipping mailer/envelope as shown in FIGS. 11E and 11F.

Figure 14:
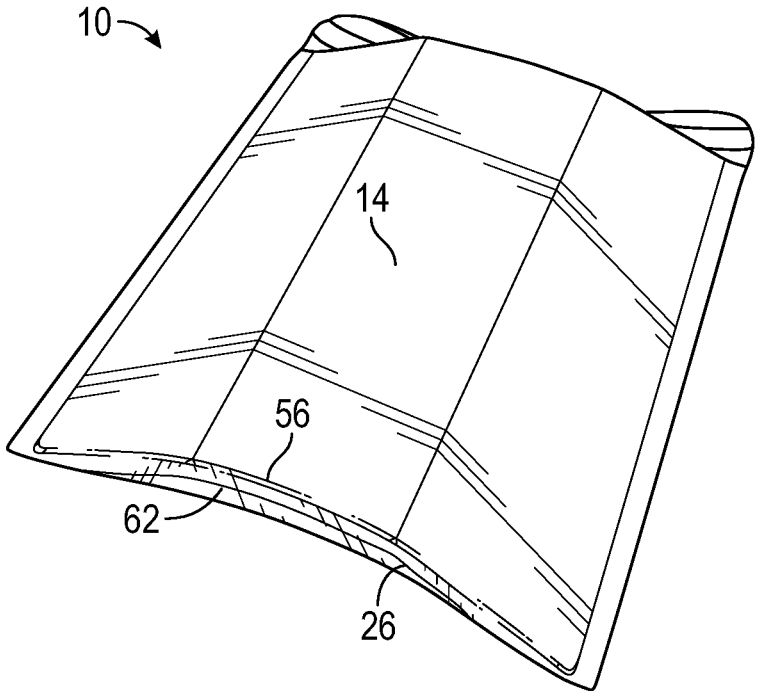
FIGS. 14-16 are perspective views of the shipping mailer/envelope of FIG. 7 in the stuffed or filled state illustrating formation of an end wall at the closed end of the shipping mailer/envelope.
Figure 15:
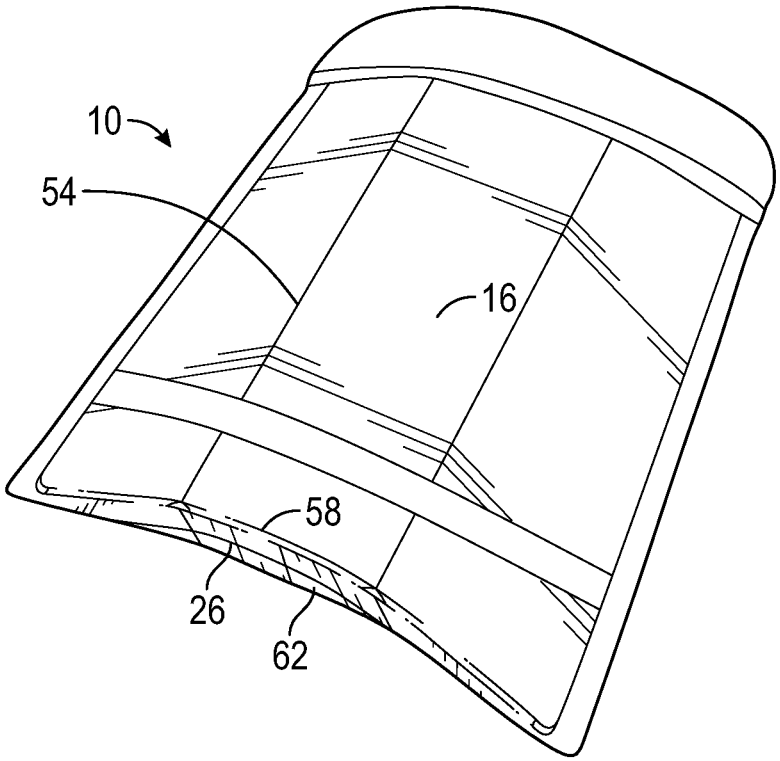
Figure 16:
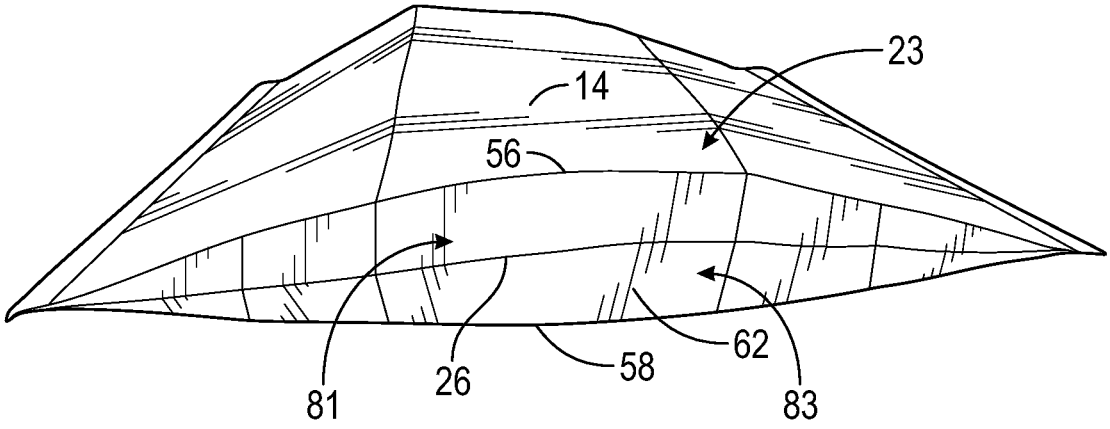

FIGS. 14 and 15 illustrate the shipping mailer/envelope 10 with the wall 14 visible (FIG. 14) and with the wall 16 visible (FIG. 15) in a filled or stuffed state with an object in the interior. The fold lines 54 are visible on the surfaces corresponding to the longitudinal creases/scores/fold lines 42A-42I in the flutes. The wall portions 81 and 83 together with the transverse scores/creases/fold lines 56 and 58 can form the flat end wall 62 on the bottom of the shipping mailer/envelope as described above. FIG. 16 is an end view of the shipping mailer/envelope 10 illustrating the end wall 62.

FIGS. 12A-13C illustrates different configurations/shapes/directions of scores/creases to allow the shipping mailer/envelope to expand to different shapes or outer profiles. In certain embodiments, these configurations can accommodate/isolate/protect a product with a thickness greater than 0.75 inch, and/or allow the shipping mailer/envelope to be less convex, and/or facilitate stacking of stuffed or filled mailers/envelopes. For example, FIG. 12A illustrates curved score lines/fold lines 76 extending longitudinally between the end portions 21 and 23. The curved fold lines 76 can be formed in the corrugated layer (e.g., layer 40) on the inside of the shipping mailer/envelope. In certain embodiments the fold lines 76 can be C-shaped, with their concave sides oriented outwardly toward respective edge portions of the shipping mailer/envelope. This can result in the hexagonal end profile illustrated in FIG. 12B with flat surfaces on the top and bottom (e.g., on the main walls 14 and 16). The fold lines 76 can be formed in either or both of the walls 14 and/or 16.

FIG. 13A illustrates another embodiment in which the mailer/envelope includes longitudinally-extending fold lines 78 similar to the fold lines 42A-42I that decrease in length toward the central axis 79 of the shipping mailer/envelope. This can allow the shipping mailer/envelope to accommodate rectangular objects 45 of varying size/width/thickness and provide the generally hexagonal end profile illustrated in FIGS. 13B and 13C. In the illustrated embodiment, the fold lines 78 can extend perpendicular to the axes of the corrugations/flutes (e.g., the corrugations can extend along the x-axis while the fold lines 78 extend along the y-axis), although the fold lines may also extend at an angle to the corrugations/flutes. The fold lines 78 can be formed in either or both of the walls 14 and/or 16. The shipping mailer/envelope can also include any number of fold lines 78 with any spacing, and having any length according to the particular characteristics desired.

Figure 17:
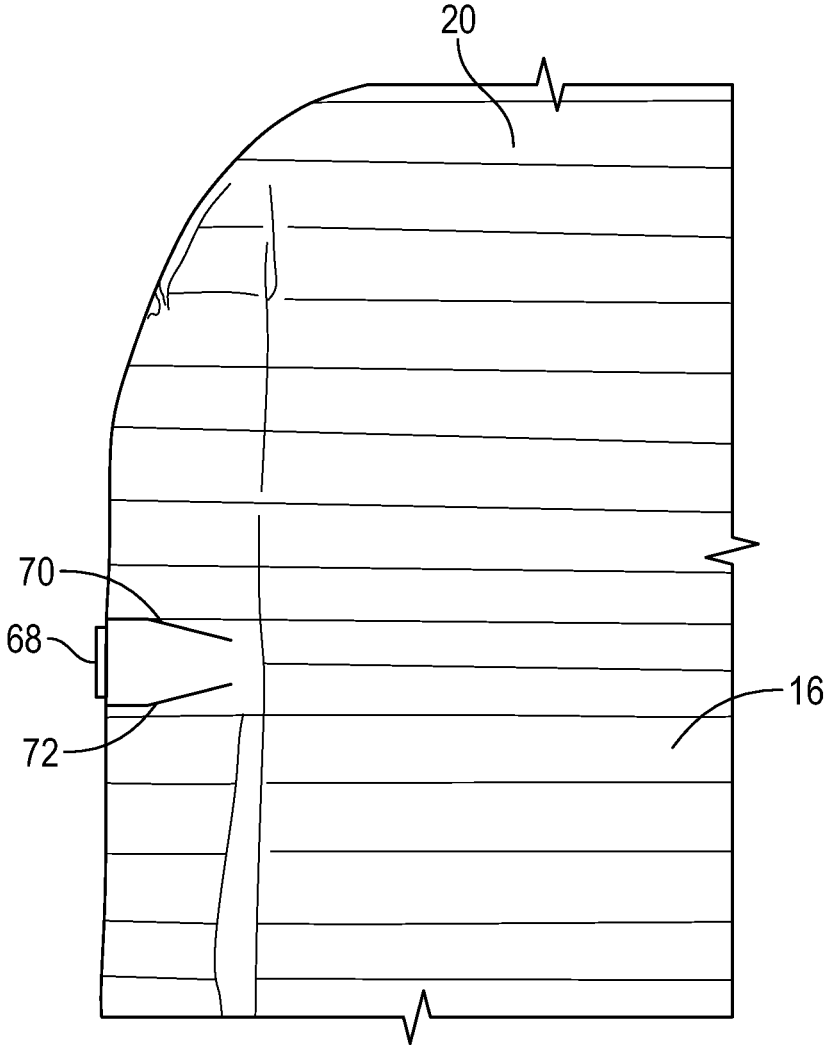
FIG. 17 is a magnified view of a tearable closure of the shipping mailer/envelope of FIG. 7, according to one embodiment.

FIG. 17 is a magnified view of the upper left corner of the second wall 16 and the flap 20 of the shipping mailer/envelope 10 illustrating one end of an opener member configured as a tear string 68. The shipping mailer/envelope can comprise an area of weakness proximate the end of the tear strip 68. In embodiments in which the shipping mailer/envelope comprises a single-face corrugated material, the area of weakness can comprise a pair of angled slits or cuts 70, 72 in the liner layer of the single-face corrugated material. The cuts 70, 72 can reduce the force required to initiate removal of the tear strip to open the mailer/envelope. In certain embodiments, the opener member 68 can be the same length as the opening at the second end portion 23 of the shipping mailer/envelope, nearly the same length, or shorter than the opening. In other embodiments, the opener member 68 can comprise a perforated strip.

Figure 18A:
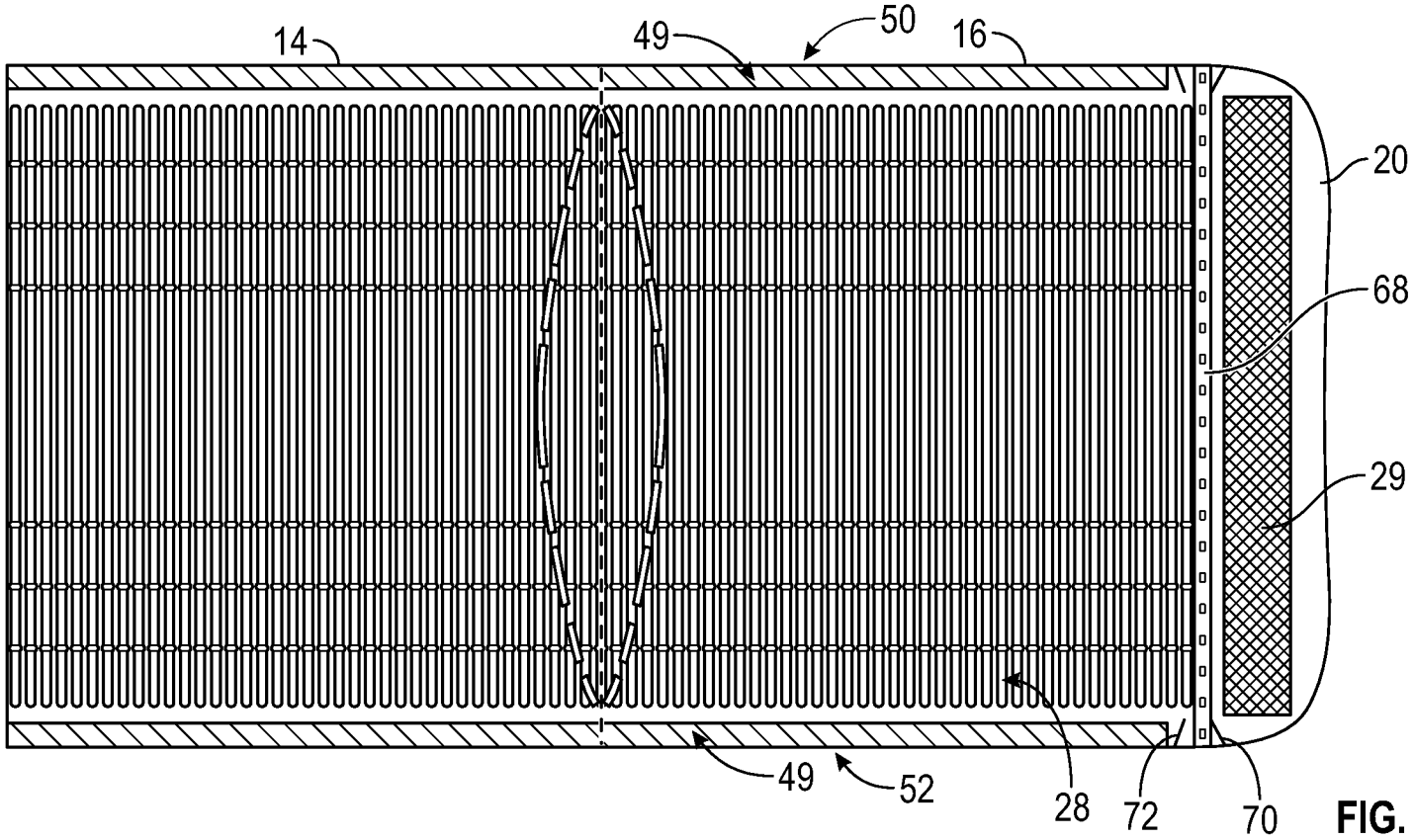
FIGS. 18A and 18B illustrate a fin seal of the shipping mailer/envelope of FIG. 7, according to one embodiment.
Figure 18B:
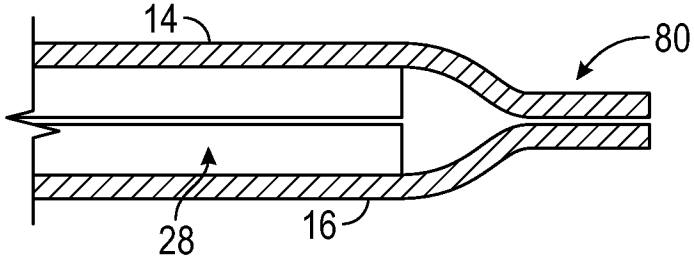

FIGS. 18A-22B illustrate different styles/configurations of seals that can be used to secure the edges of the shipping mailer/envelope 10 together. The following seals can also be applicable to any of the other shipping mailer/envelope embodiments described herein. The following seals can also provide improved closure integrity and sift resistance to any of the embodiments described herein. FIGS. 18A and 18B illustrate a fin seal. For example, in certain embodiments the corrugations 28 can stop short of the edges of the side portions 50 and 52, allowing portions of each wall (e.g., the backing/liner layer where the mailer comprises single-face corrugated material) to directly overlap at the edges. Adhesive layers indicated at 49 such as hot melt, glue, etc., can be applied to the side portions 50 and 52, and the overlapping sections of the first and second walls 14, 16 can form fin seals 80 when the walls are folded together, as shown in FIG. 18B. The configuration in FIG. 18A can also include a release liner 29 on the flap 20 over an adhesive, and a set of slits or pre-cuts 70, 72 on each side of the wall 16 for a tear string or other opener member.

Figure 19A:
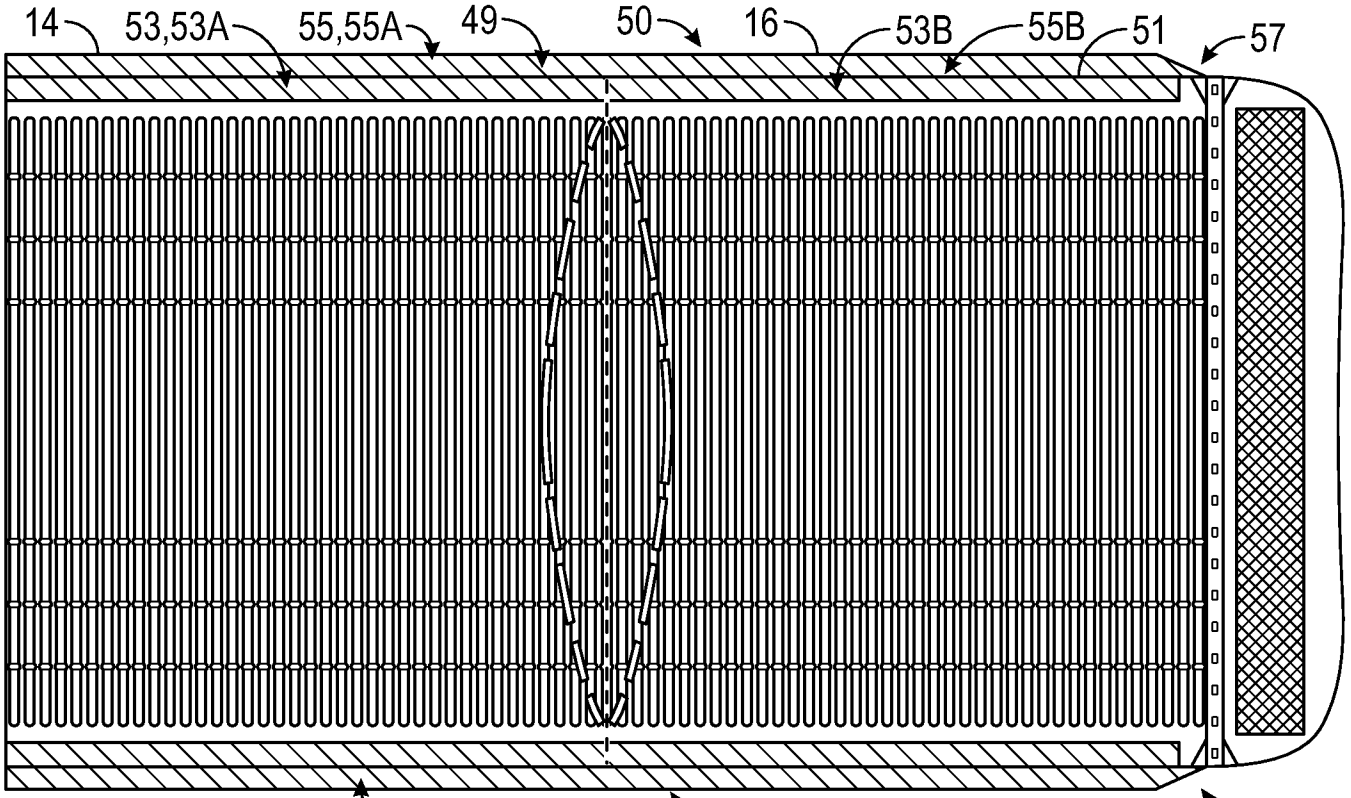
FIGS. 19A and 19B illustrate another embodiment of a shipping mailer/envelope including a fin seal folded to form a cuff.
Figure 19B:
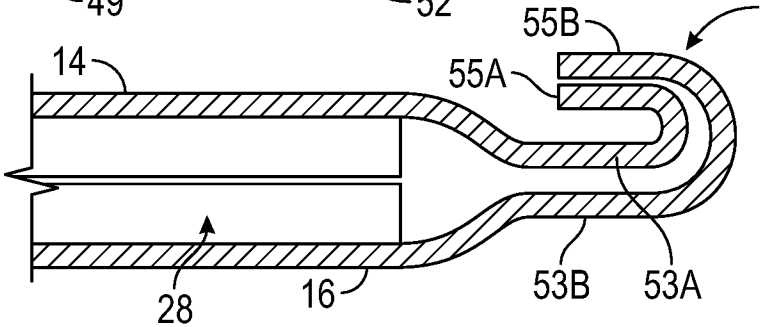

In certain embodiments, the fin sealed portions can be folded over and adhered or secured to form a cuff 82 for additional strength, as shown in FIGS. 19A and 19B. More particularly, with reference to the edge portion 50 for purposes of illustration, in certain embodiments the edge portions can comprise respective fold lines such as the fold line 51. The fold line 51 can divide the edge portion 50 into an inner region 53 and an outer region 55. Adhesive layers 49 can be applied to any or all of the regions 53 and 55. When the walls 14 and 16 are folded together, the inner region 53A of the wall 14 can be adhered to the inner region 53B of the wall 16, and the outer region 55A of the wall 14 can be adhered to the outer region 55B of the wall 16 to form a fin seal, as described above with reference to FIGS. 18A and 18B. Once adhered, the edge portion 50 can be folded about the fold line 51 to overlay the adhered regions 55A and 55B over the adhered regions 53A and 53B. FIG. 19B illustrates the resulting cuff 82 formed when the portions 55A and 55B are folded onto the first wall 14, although the portions 55A and 55B can be folded onto the wall 16 as well. In FIG. 19B, the various regions 53A-55B are shown spaced apart for purposes of illustration, but in practice can be overlaid in close contact. In certain embodiments, the portions 53A and 55A can be adhered together to form the cuff 82. Referring again to FIG. 19A, in certain embodiments one or both of the edge portions 50, 52 can also comprise a corresponding fin cut back area generally indicated at 57 and 59, respectively.

Figure 20A:
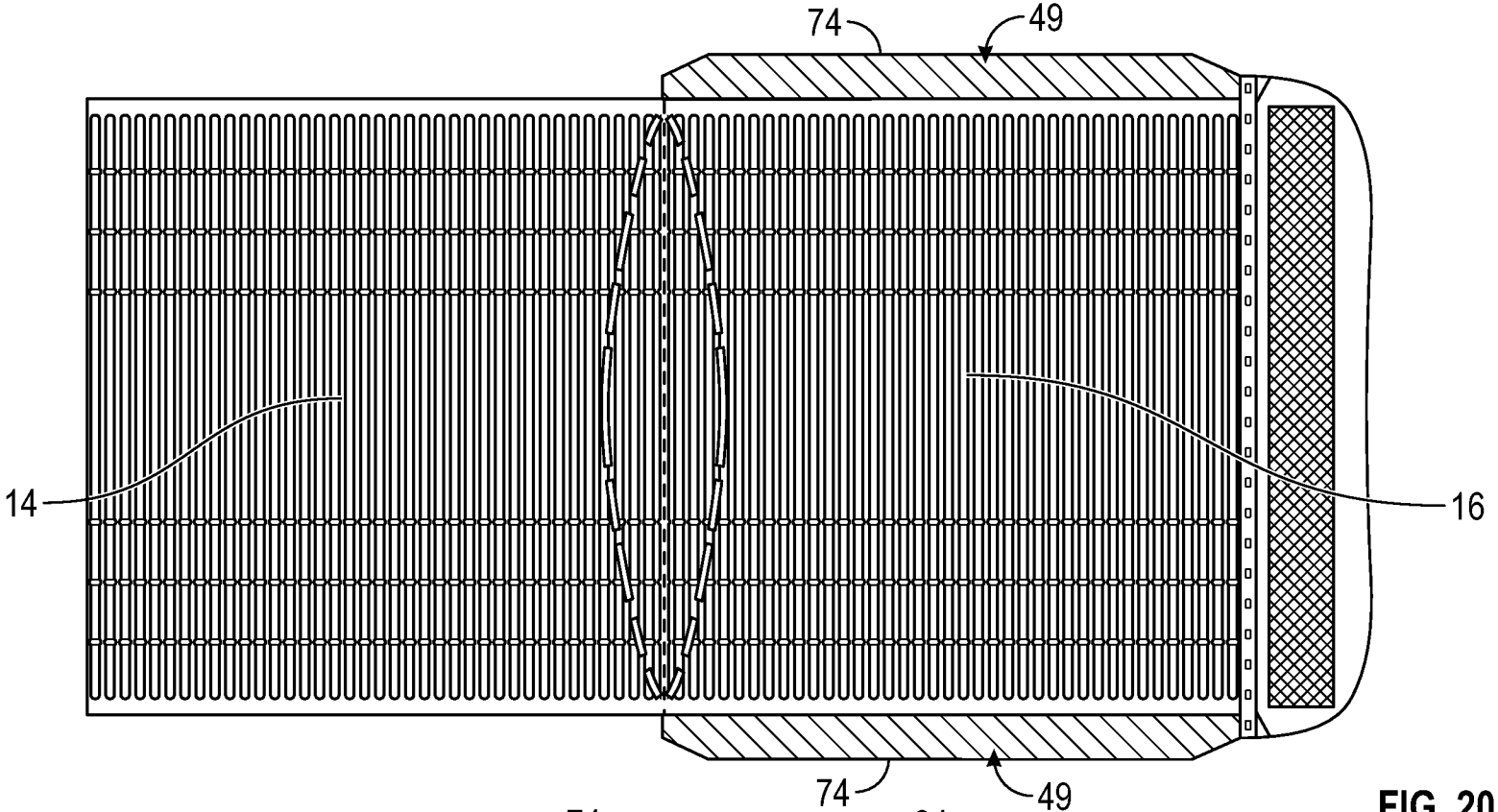
FIGS. 20A and 20B illustrate another embodiment of a shipping mailer/envelope including a lap seal.
Figure 20B:
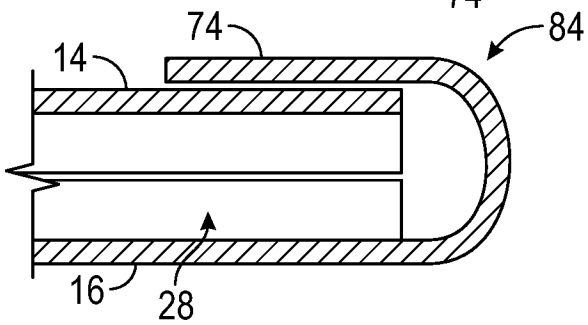

FIGS. 20A and 20B illustrate another embodiment in which the edges of the shipping mailer/envelope are sealed or coupled together with rolled edge seals in which one edge is folded over the other and secured or adhered to form a lap seal 84 (FIG. 20B). In such embodiments, one wall of the mailer/envelope (e.g., the liner layer of the second wall 16 in FIG. 20A) can include edge portions 74 configured to be folded over to form the seal, and the other wall need not include such edges portions, as shown in FIGS. 20A and 20B. To assemble the shipping mailer/envelope, the first wall 14 can be folded over onto the second wall 16, and the edge portions 74 of the second wall 16 can be folded around the edges of the first wall 14 and adhered/glued/secured to form the lap seal 84, as shown in FIG. 20B. Adhesive layers applied to the edges 74 are indicated at 49. In other embodiments the wall 14 can include the edge portions 74.

Figure 21A:
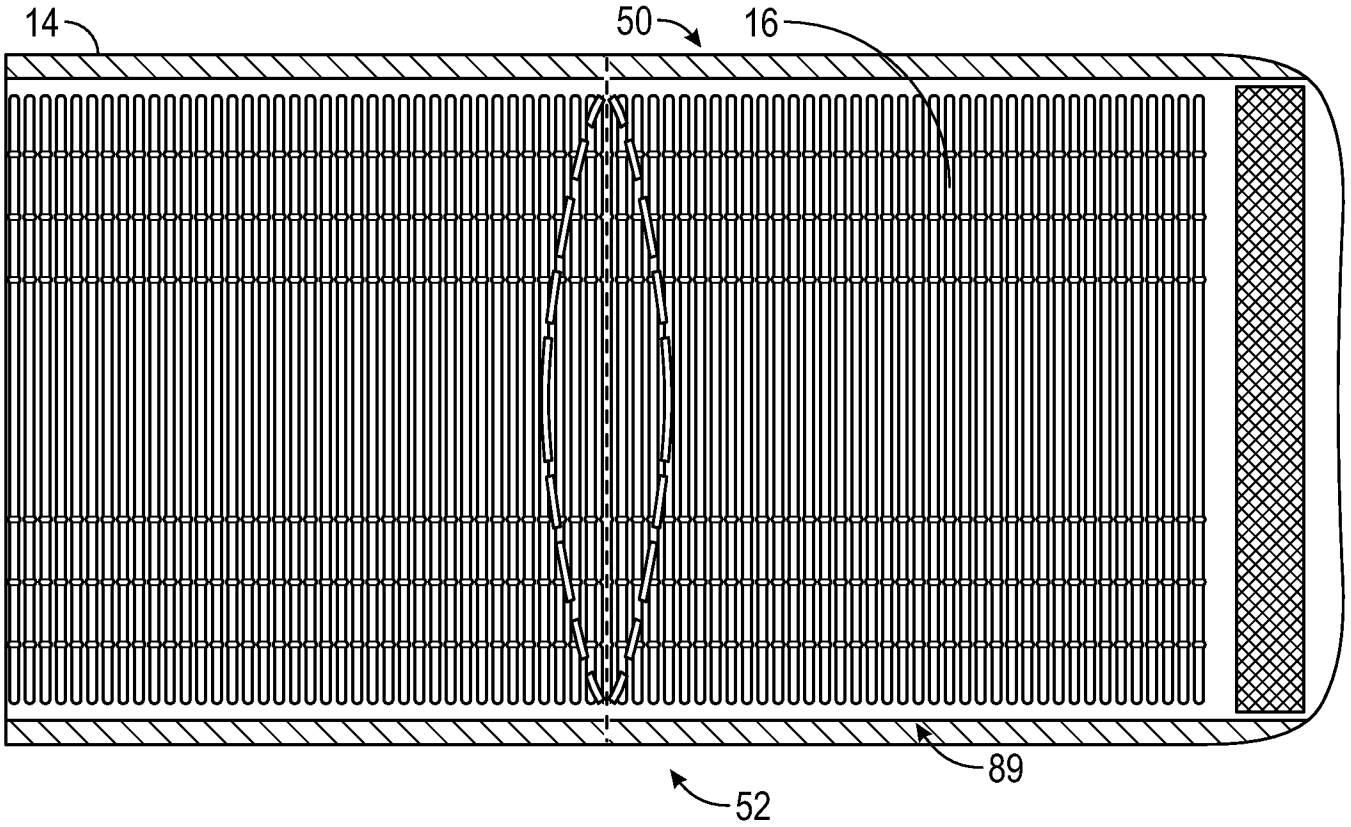
FIGS. 21A and 21B illustrate another embodiment of a shipping mailer/envelope with a fin seal including a plurality of longitudinally extending filaments.
Figure 21B:
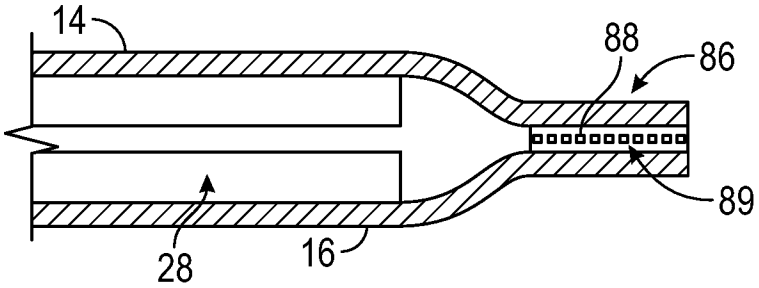

FIGS. 21A and 21B illustrate a fin seal 86 incorporating one or a plurality of strings/threads/cords/braids/filaments/wires or other elongated members 88 between the sealed edges of the walls. In certain embodiments, one or more of the elongated members 88 can be configured as an opener member. The fin seals 86 can also incorporate one or more beads of adhesive/hot melt glue, or other securing or fastening means. In certain embodiments, the strings/threads/cords/braids/filaments/wires 88 can be embedded in the adhesive or glue layer 89 applied to the edge portions 50, 52, as shown in FIG. 21B. In certain embodiments, the strings/threads/cords/braids/filaments/wires 88 can create an opening or access into the interior of the mailer/envelope when pulled or removed from the fin seals 86. Such opener members can be included in addition to, or in place of, a laterally-extending opener member at the top of the mailer/envelope as described elsewhere herein.

Figure 22A:
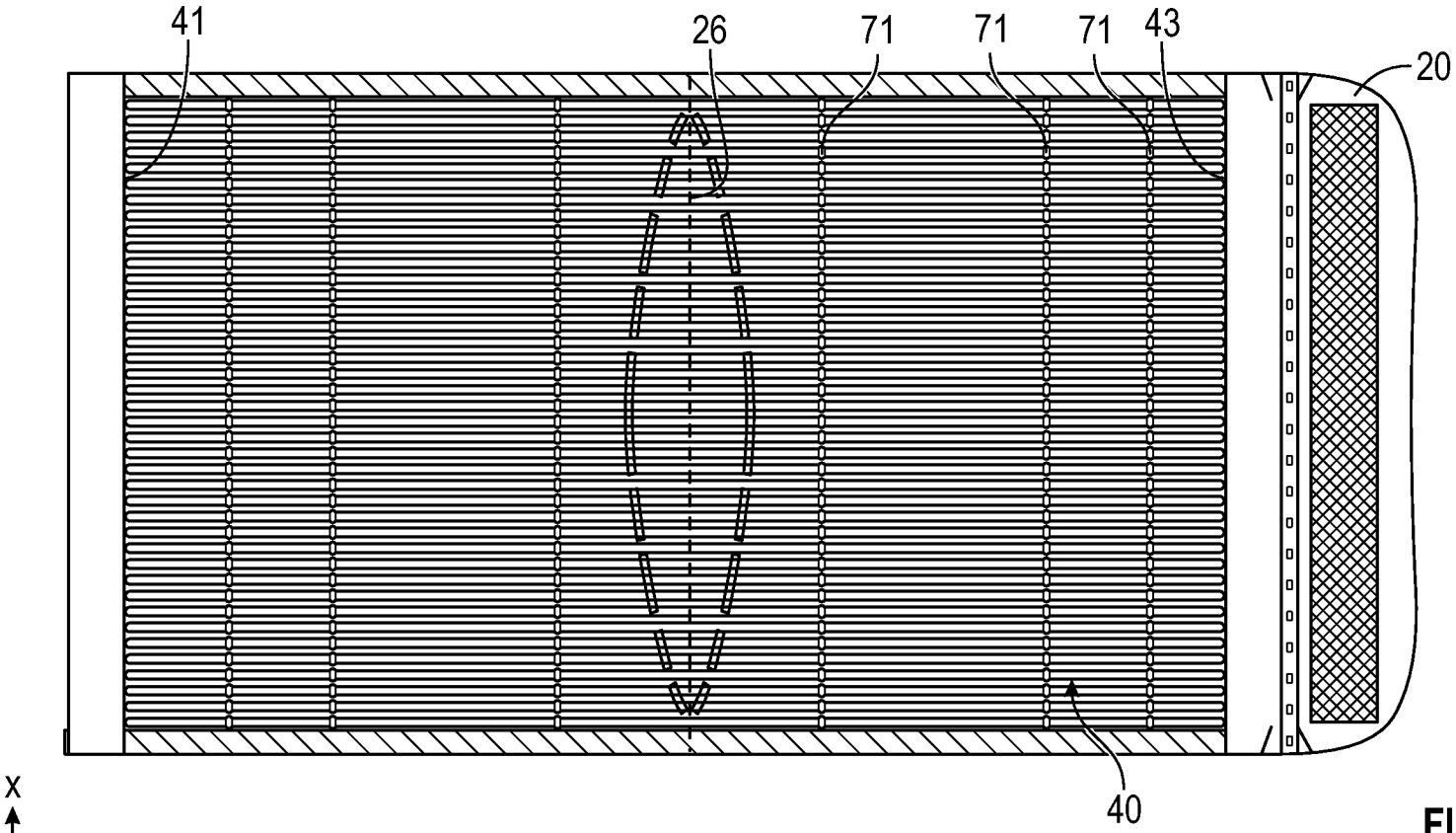
FIGS. 22A and 22B illustrate another embodiment of a shipping mailer/envelope in which the corrugations extend longitudinally, and including a fin seals along the longitudinal edges.
Figure 22B:
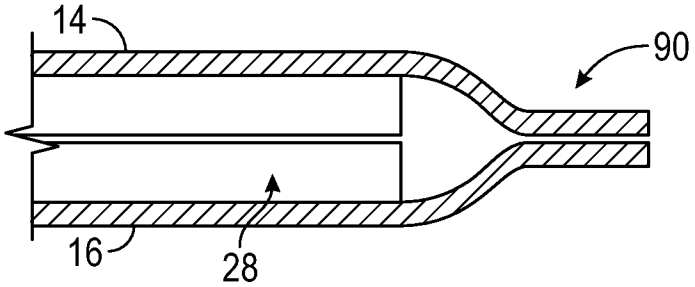

FIGS. 22A and 22B illustrate another embodiment of the shipping mailer/envelope including fin seals 90 at the side portions in which the corrugations extend longitudinally along the y-axis. The edges of the corrugated layer/walls can be skived such that the liner layer extends beyond the corrugated layer in the x-dimension. In certain examples, a portion of the corrugated layer can be removed or skived in areas corresponding to the fin seals at suitable times during manufacture, such as during early stages of manufacture to facilitate forming a fin seal. In other embodiments, the corrugated layers of the walls 14 and 16 can extend to the longitudinal edges of the liner layer and can be sandwiched in the fin seals. In yet other embodiments, the corrugated layer can be shortened in the x-dimension such that the backing layer extends beyond the corrugated layer to facilitate to formation of fin seals.

FIG. 22A also illustrates other features which may be incorporated into any of the embodiments described herein, such as corrugations/flutes extending along the y-axis, and scores/creases/fold lines 71 extending along the x-axis perpendicular to the direction of the corrugations/flutes. In certain embodiments, the edges of the corrugated layer 40 can be offset from the end of the blank. For example, in the illustrated embodiment the corrugated layer 40 can comprise an edge 41 offset from the edge of the blank toward the center fold line 26, and an edge 43 offset from the flap 20 toward the center fold line 26. In certain embodiments, the flap 20 can be free of flutes, although in other embodiments the fluted layer 40 can extend over all or a portion of the flap. In certain embodiments, the fin seals can be created with the corrugations/flutes pre-positioned between the fin seals. The flutes can also be crushed, flattened, or weakened to facilitate the walls conforming to the shape of objects received in the shipping mailer/envelope. In certain embodiments, the direction of the corrugations/flutes along the y-axis and perpendicularly to or from the opening at the top of the mailer/envelope can allow the walls to curve or bulge into convex or concave shapes to create a more rounded opening.

Figure 23:
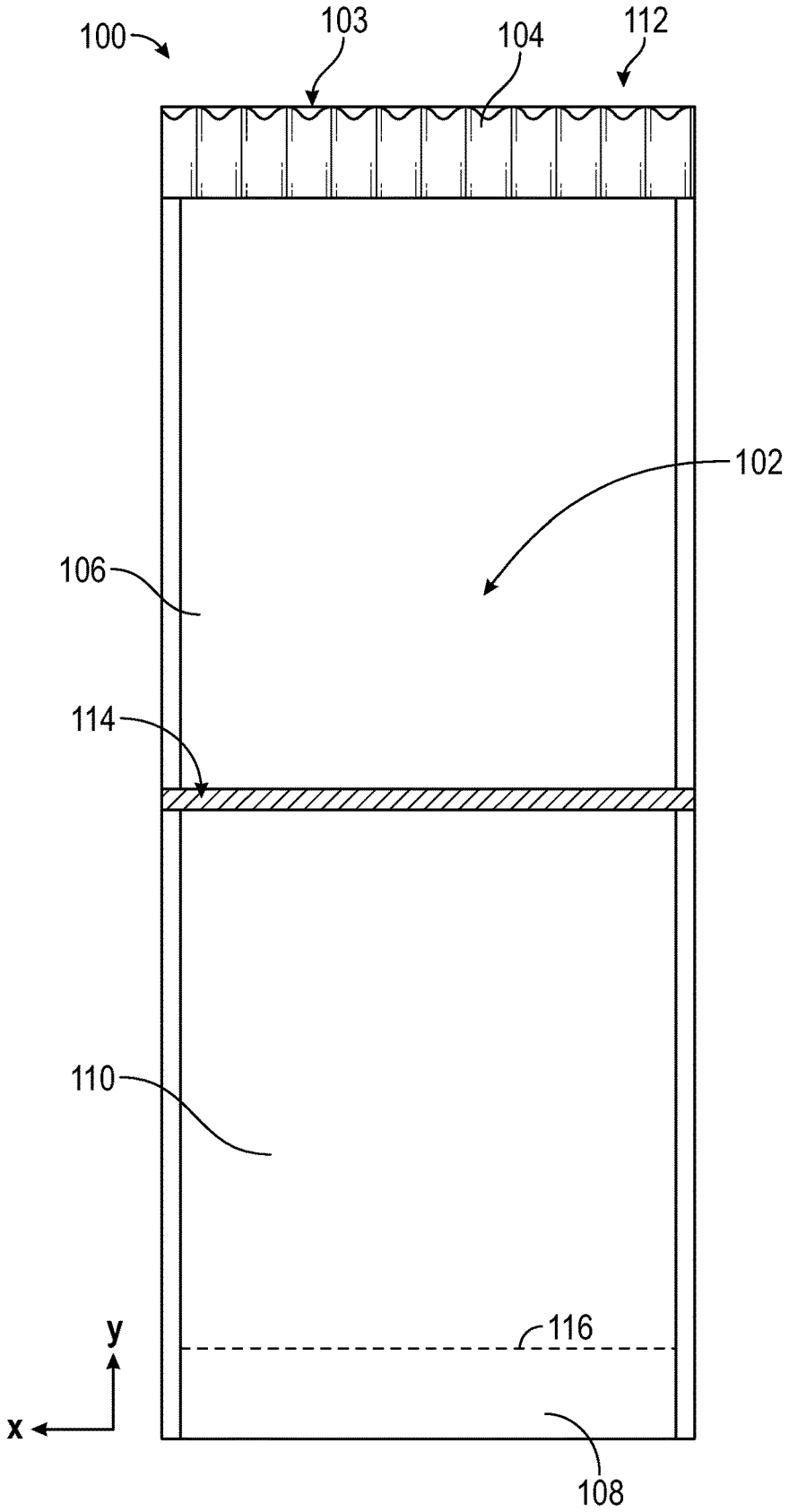
FIG. 23 is a top plan view of another embodiment of a shipping mailer/envelope in a laid-flat state comprising single wall corrugated board in which one liner layer is offset longitudinally relative to the other to expose portions of the corrugated layer on opposite sides of the shipping mailer/envelope.

FIG. 23 illustrates another embodiment of a shipping mailer/envelope 100 comprising single wall corrugated material, and shown in a laid-flat configuration. The corrugations/flutes 104 extend along the y-axis or along the length dimension of the mailer/envelope. The shipping mailer/envelope 100 can comprise a first or inner liner layer 102 and a second or outer liner layer 103 with the corrugations/flutes between the inner and outer layers. The shipping mailer/envelope can comprise a first wall 106 and a second wall 110 with a zone 114 disposed between them. In the illustrated embodiment, the inner liner 102 can be offset along the y-axis, exposing the corrugations/flutes 104 at one end of the first wall 106, and creating an overhanging or extension portion 108 extending from the opposite end of the second wall 110. Thus, the area generally indicated at 112 of the first wall 106 has open or exposed corrugations/fluting 104 on one side of the laid-flat mailer (corresponding to the interior of the mailer/envelope when assembled), and the extension portion 108 comprises open or exposed corrugations/fluting 104 on the opposite side of the mailer/envelope (corresponding to the exterior of the mailer/envelope when assembled). The dashed line 116 indicates the edge of the liner layer 103 on the back side of the blank.

The mailer/envelope 100 can also comprise a zone 114 where the corrugations/flutes 104 are crushed or flattened. When the shipping mailer/envelope is closed, the wall 110 can be folded over onto the wall 106 along the zone 114. The extension portions 108 and 112 can then be folded such that the exposed corrugations of each portion mate or nest together. In certain embodiment, the portions 108 and 112 can be adhered or secured to each other, such as by adhesive applied to the corrugations and/or by fasteners. The zone 114 can also allow for a slight offset or separation between the walls when sealing the longitudinal edges (e.g., by fin sealing) to facilitate nesting of the exposed corrugations of portions 108 and 112 when mated together. In embodiments in which the corrugations/flutes extend to the longitudinal edges of the backing layer, the flutes can be crushed to facilitate formation of fin seals. In other embodiments, the corrugated layer can be skived along the longitudinal edges such that the liner layers extend beyond the corrugated layer along the x-axis. In certain embodiments, this configuration can provide a reduction in material, and a smoother outer profile of the finished mailer/envelope. The corrugations/flutes are shown oriented along the y-axis, although in other embodiments they can extend along the x-axis or in other directions.

Figure 24:
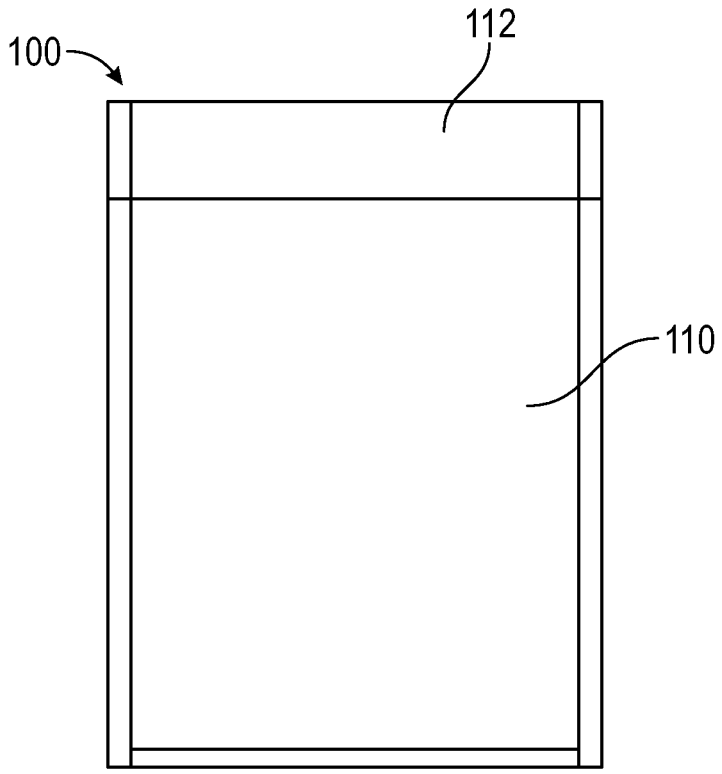
FIG. 24 is a top plan view of the shipping mailer/envelope of FIG. 23 in the assembled state.

FIG. 24 illustrates the walls of the single wall shipping mailer/envelope 100 of FIG. 23 folded together to form the shipping mailer/envelope with the portion 112 overlaying the portion 108. In certain embodiments, the shipping mailer/envelope can be configured such that upon folding the walls to form the shipping mailer/envelope, one wall is laterally offset or skewed relative to the other (e.g., by a small distance such as ⅛ inch along the x-axis). This can allow a user to know whether the corrugations/flutes are mated or engaged on the flap. At the fold line/zone 114 between the walls, the corrugations/flutes can be crushed, and/or can comprise slits or cuts such as chevron-shaped slits to create the interior shift or skew of the corrugations/flutes of one wall relative to the other. In certain embodiments, the shipping mailer/envelope 100 can be cut from a roll of single wall material, folded, filled or packed, and sealed in a continuous process as described elsewhere herein.

Figure 25A:
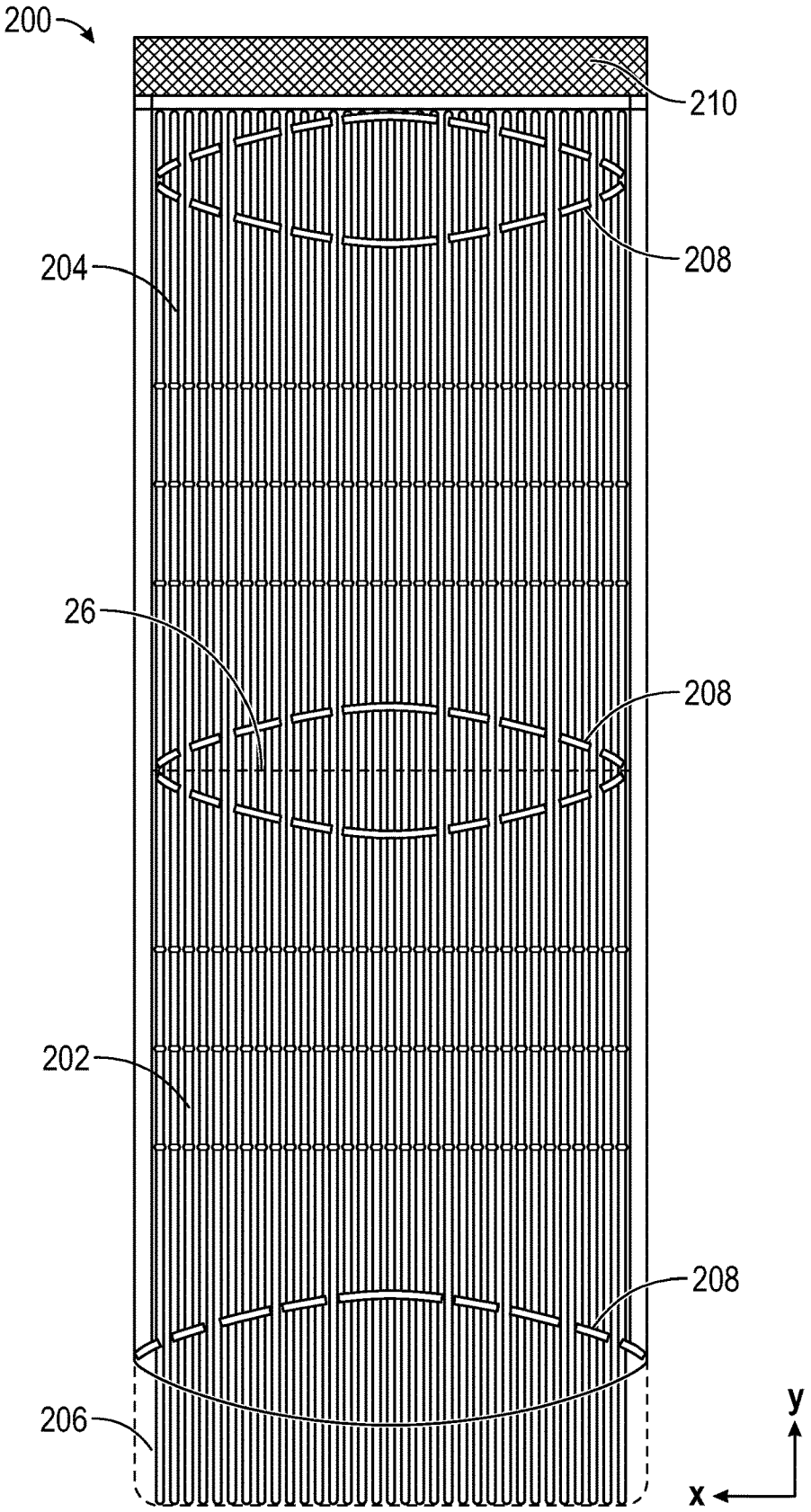
FIG. 25A is a top plan view of another embodiment of a shipping mailer/envelope in a laid-flat state including sets of curved, preformed fold lines in the corrugations at the closed end and the open end of the shipping mailer/envelope.
Figure 25B:
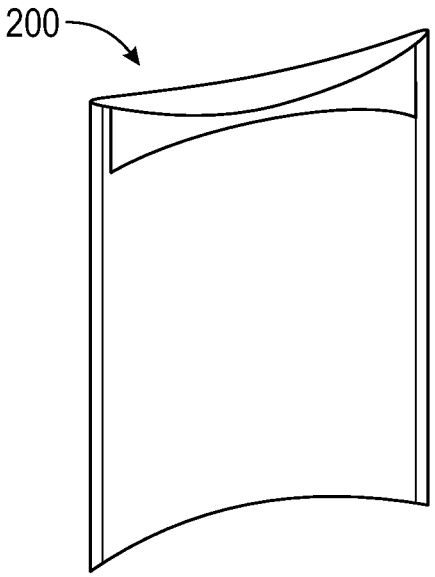
FIG. 25B is a perspective view of the of the shipping mailer/envelope of FIG. 25A in the assembled, closed state.

FIGS. 25A and 25B illustrate another embodiment of a shipping mailer/envelope 200 with corrugations oriented longitudinally along the length dimension of the shipping mailer/envelope in the direction of the y-axis. The shipping mailer/envelope 200 can comprise a first wall 202 and a second wall 204. In the illustrated embodiment, the first wall 202 can comprise an extension portion or "tuck" portion 206. In certain embodiments, an extension portion or tuck portion 206 at either or both ends can provide a straight edge to facilitate manufacturability. In certain embodiments the tuck portion 206 can be used to adhere the flap. FIG. 25B illustrates the mailer/envelope 200 in the closed or sealed configuration. In the illustrated embodiment, the shipping mailer/envelope 200 can comprise multiple sets of curved fold lines 208 extending between the longitudinal edge portions of the walls similar to the fold lines 56 and 58 of FIG. 9. The fold lines 208 can be configured to allow the shipping mailer/envelope to expand at different locations along its length, such as at the closed end portion and at the open end portion. In certain embodiments, the shipping mailer/envelope 200 can comprise a sealing strip portion 210 on the closure flap at the opposite end of the laid-flat shipping mailer/envelope from the tuck portion 206.

Figure 26:
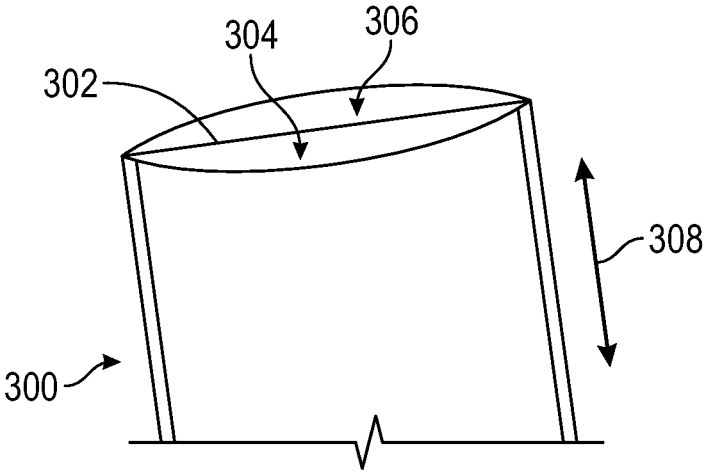
FIG. 26 is a perspective view of another embodiment of a shipping mailer/envelope including an interior wall defining multiple pockets.

FIG. 26 illustrates another embodiment of a shipping mailer/envelope 300 including multiple interior compartments separated by a divider 302. For example, in the illustrated embodiment the shipping mailer/envelope 300 can comprise two compartments 304 and 306 separated by the internal divider 302, or more. In certain embodiments, the shipping mailer/envelope 300 can be a "trifold" or "z-fold" shipping mailer/envelope including multiple walls to create the divider(s) and exterior walls of the shipping mailer/envelope. The corrugations/flutes can extend longitudinally between the end portions as indicated by double-headed arrow 308 in FIG. 26, or laterally between the side portions, depending upon the particular characteristics desired. In certain embodiments, the shipping mailer/envelope 300 can be made from single-face corrugated and/or single wall corrugated, or any of the other materials described herein.

Third Representative Embodiment

FIGS. 27-33 illustrate other embodiments of shipping mailers/envelopes that can be produced, filled (e.g., have an object placed inside the shipping mailer/envelope), and closed or sealed in a continuous in-line process from a supply of bulk cellulosic fiber-based material (e.g., single-face corrugated, single wall corrugated, paperboard, cardboard, etc.).

FIG. 27 illustrates a section or portion of feedstock material 400 (e.g., a roll of material) that can be used to produce shipping mailers/envelopes. A plurality of features can be formed in the feedstock material 400 in a continuous process. For example, in the illustrated embodiment sinusoidally-shaped fold lines 402 such as creases, cuts, indentations, etc., can be formed in the corrugations/flutes. In particular embodiments, four curved fold lines 402A, 402B, 402C, and 402D can be formed, with the fold lines 402A and 402B extending along a common axis 418 and overlapping/intersecting each other at nodes 408 along the common axis 418. The fold lines 402A and 402B can be sinusoidally varying, and can be phase-shifted by 180°, although other configurations are possible. The fold lines 402A and 402B can be located proximate a first edge portion 404 of the feedstock material (e.g., offset from a central axis 416 of the feed stock toward the first edge portion 404). The fold lines 402C and 402D can also be sinusoidal and phase-shifted, and can extend along a common axis 420. The fold lines 402C and 402D can overlap/intersect each other at nodes 410 along the axis 420. The fold lines 402C and 402D can be offset from the central axis 416 toward a second edge portion 406 of the feedstock material.

Adhesive strips 412 (e.g., hot melt glue) can be applied at positions along the x-axis corresponding to the nodes 408 and 410. The adhesive strips 412 can extend along the y-axis between the edge portions 404 and 406, with their end portions offset inwardly from the edge portions 404 and 406. In certain embodiments, pieces or sections of the feedstock material 400 can be separated/cut/sheared (e.g., by heat seal cutting) along, for example, the lines 414 shown passing through the adhesive strips 412 in a serial manner to form multiple mailers/envelopes in a continuous process. The distance L between the lines 414 can correspond to the width dimension of the resulting shipping mailer/envelope. When the sections of the feedstock material are separated, the fold lines 402A-402D of the resulting shipping mailer/envelopes (or blanks) can be configured similarly to the fold lines 56 and 58 of FIG. 9, the fold lines 64 of FIG. 11D, and/or the fold lines 208 of FIG. 25A.

In certain embodiments, the inward-most opposed apices of the fold lines 402A/402B and 402C/402D can be spaced apart by a distance W. This measurement is indicated between an apex of fold line 402B and a corresponding opposed apex of fold line 402C near the center of FIG. 27 that are closest to the longitudinal axis 416 of the feedstock material 400. In certain embodiments, the distances between the longitudinal edges of the edge portions 404 and 406 of the feedstock and the apices or crests of the fold lines 402A-402D can be determined according to the distance W. For example, in the illustrated embodiment the distance Y1 between the edge of the edge portion 404 and the outer-most apices/crests of the fold lines 402A and 402B can be a fraction of the distance W, such as ¾ W. In certain embodiments, the distance Y2 between the edge of the edge portion 406 and the outer-most apices/crests of the fold lines 402C and 402D can also be a fraction of the distance W, such as ½ W. The dimensions Y1 and Y2 may be the same or different depending upon the particular design and/or equipment used. The various edges can be sealed with tape, adhesive, or other sealing means, in a belly closure or other closure style/location/construction.

In a representative method, the fold lines 402A-402D can be formed in the corrugations of the feedstock material 400 as it moves through production equipment in the direction of the x-axis. The regions 412 can be formed at selected intervals (e.g., aligning with nodes where the fold lines 402A and 402B intersection and where the fold lines 402C and 402D intersect), such as by flattening or crushing the corrugations (e.g., by stamping or rolling). Longitudinal fold lines such as any the fold lines 42A-42I of FIG. 9 can be formed in the corrugations. Adhesive can be applied to the regions 412, and/or to edge portions of the feedstock material. An opener member can be applied or installed, for example, along one of the longitudinal edge portions which will form the ends of the resulting shipping mailer/envelope. The feedstock material can be cut or separated into pieces along the regions 412 to form shipping mailer/envelope blanks. The resulting blanks can then be folded, before or after a product is inserted, and sealed to form a shipping mailer/envelope. The shipping mailer/envelopes can then proceed for further processing, such as addressing and shipment. Different width shipping mailer/envelopes can be produced by varying the distance between intersections/nodes of the fold lines 402A/402B and 402C/402D, and the corresponding locations of the regions 412. This can enable continuous production of shipping mailer/envelopes of various sizes and/or styles, and continuous filling and sealing of the shipping mailer/envelopes in real time according to, for example, a selected order of different products to be shipped.

Figure 28:
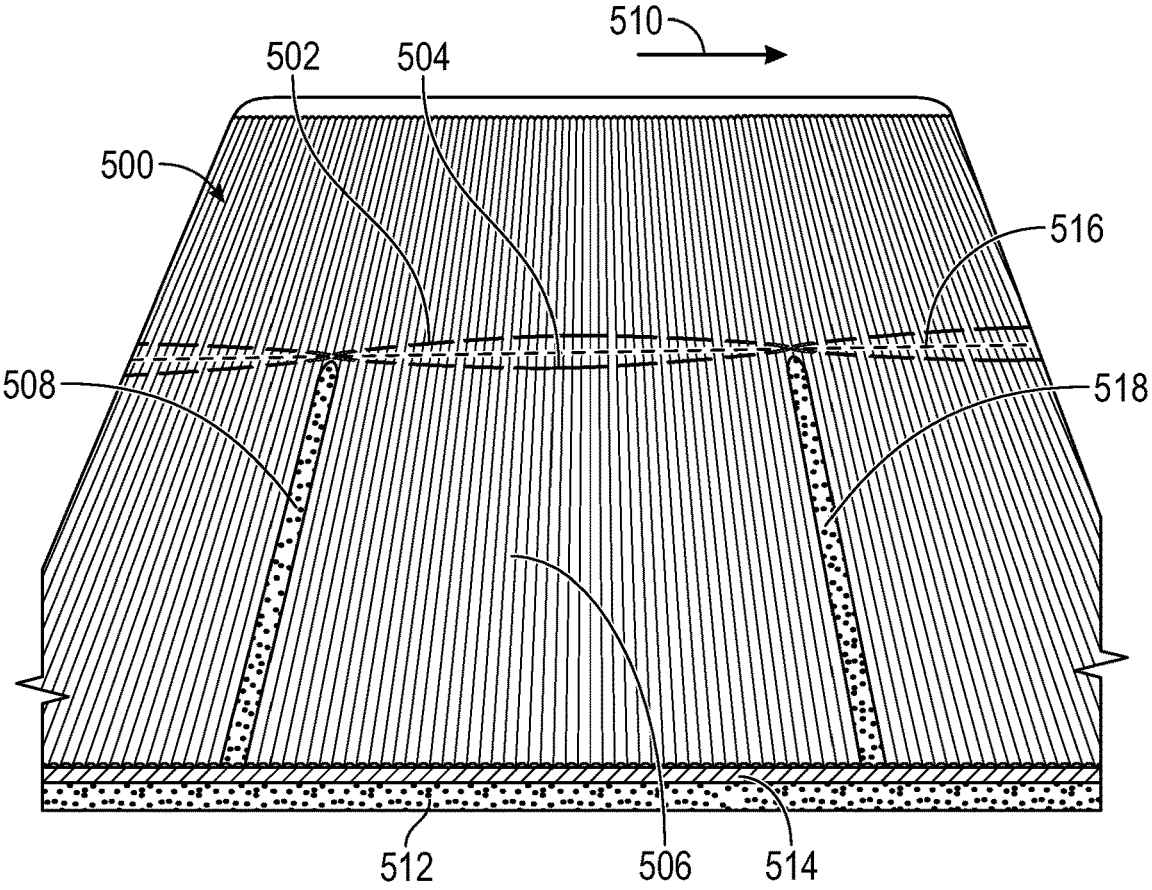
FIG. 28 is a perspective view of a portion of a feedstock material for forming shipping mailers/envelopes in a continuous process, according to another embodiment.

FIG. 28 illustrates a section of single-face corrugated feedstock material 500 that can be used to produce shipping mailers in a continuous process, according to another embodiment. The feedstock material 500 can comprise two sinusoidally-extending or curved fold lines 502, 504 formed in corrugations/flutes 506, and areas or sealing regions 508 and 518 located on one side of the fold lines 502, 504, nearer the viewer in FIG. 28. The sealing regions 508 and 518 can comprise adhesive, and in certain embodiments the corrugations in the regions 508, 518 can be crushed or flattened, or cut or skived away. The corrugations/flutes 506 can extend perpendicular to the direction of travel of the feedstock through the production machinery indicated by arrow 510. A straight fold line or hinge line 516 can extend between the curved fold lines 502 and 504 bisecting the nodes where the fold lines 502, 504 cross or intersect. At least one edge portion 512 of the feedstock material can comprise adhesive, such as hot melt glue, applied to the edge portion of the feedstock material. In certain embodiments, an opener member such as a tear strip 514 can also be applied or incorporated along one edge portion, such as the edge portion 512.

To form a mailer/envelope blank, the hinge line 516 (e.g., a fold line), and the sinusoidal fold lines 502 and 504, can be formed in the feedstock material 500 as it travels through production equipment. In certain embodiments, the regions 508 and 518 can be formed in the corrugations, such as by flattening or crushing the corrugations. In certain embodiments, one or both of the regions 508 and/or 518 can be aligned with nodes where the fold lines 502 and 504 intersect. In certain embodiments, adhesive can be applied to the edge portion 512 and the regions 508 and 518. An opener member can be applied or installed, for example, along one of the longitudinal edge portions which will form the ends of the resulting shipping mailer/envelope. In certain embodiments, longitudinal fold lines such as any the fold lines 42A-42I of FIG. 9 can be formed in the corrugations. The feedstock material 500 can be cut, separated, or divided along the sealing portions 508 and 518, and folded along the hinge line 516. The resulting shipping mailer/envelope blank can then receive a product (e.g., a product can be inserted into an open end of the blank). The blank can be sealed at closures formed along the three free edges 508, 512, and 518 with the corresponding edges of the opposite wall to form a sealed, stuffed shipping mailer/envelope. Different width shipping mailer/envelopes can be produced by varying the distance between intersections/nodes of the fold lines 502 and 504 and the corresponding locations of the regions 508 and 518.

Figure 29:
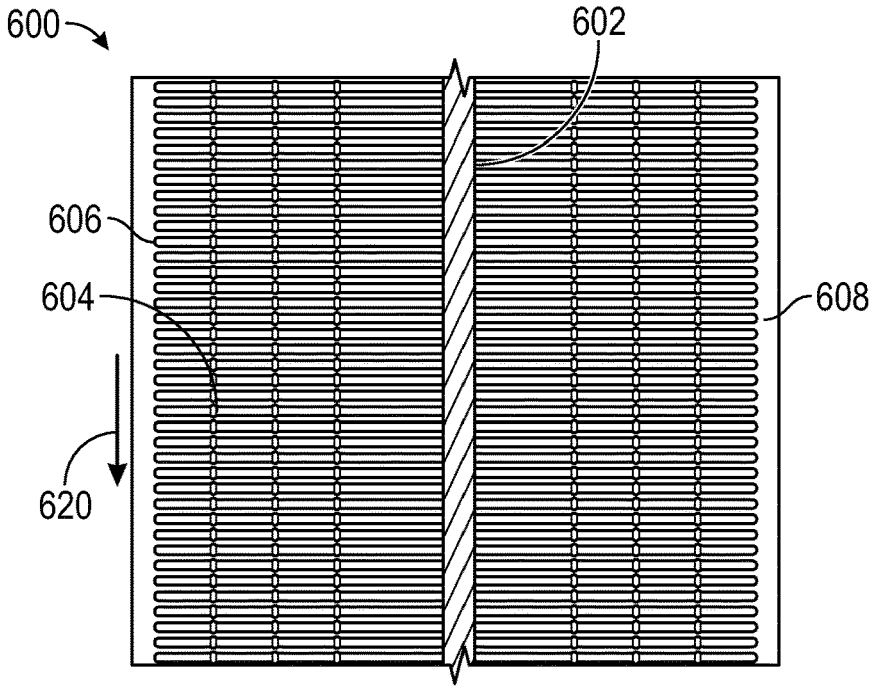
FIGS. 29-31 illustrate a series of process steps for forming, filling, and sealing a shipping mailer/envelope in a continuous process.
Figure 30:
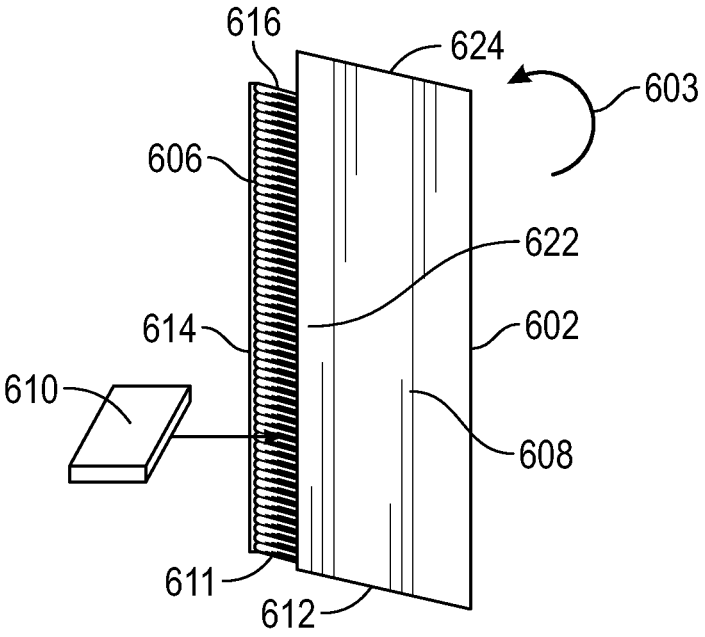
Figure 31:
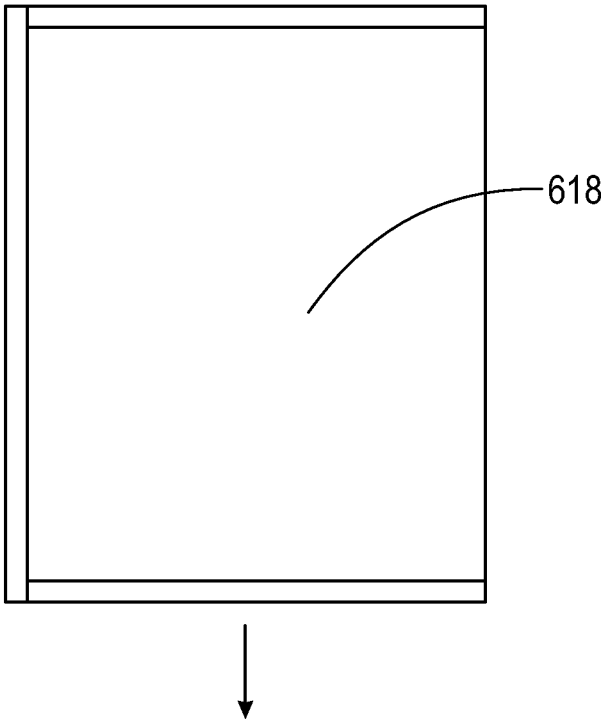

FIGS. 29-31 illustrate a method of producing shipping mailers/envelopes which can include forming various fold lines/hinge lines in the bulk cellulosic fiber-based material (e.g., single-face corrugated material, single wall corrugated material, etc.), separating the shipping mailers/envelopes from feedstock, folding the blanks along the fold lines/hinge lines, filling the shipping mailers/envelopes, and sealing the completed and filled shipping mailers/envelopes in a continuous process, according to another embodiment. FIG. 29 illustrates a shipping mailer/envelope blank 600, which can be configured similarly to the embodiment shown in FIG. 28, or any of the other embodiments described herein. The blank 600 can comprise a fold line or hinge line 602 formed in the corrugations/flutes 604 and extending perpendicular to the direction of the corrugations/flutes 604, and parallel to the direction of motion through the production equipment indicated by arrow 620. The hinge line 602 can be narrow or wide, and the corrugations/flutes can be crushed and/or cut or scored to form the hinge line. The blank 600 can be created from a roll or reel of material such as single-face corrugated, or from a continuously layered or folded (e.g., z-folded) stack or pile.

In FIG. 30, the blank 600 can be at least partially folded or pivoted about the hinge line 602 in the direction indicated by arrow 603 to create a first wall 606 and a second wall 608. An object 610 such as a product to be shipped can be disposed/placed/located between the walls 606 and 608. The first/front/leading edges of the walls, such as the edge 611 of the wall 606 and the edge 612 of the wall 608, can then be sealed together (e.g., with adhesive, fasteners, or combinations thereof) along a first closure. The second longitudinal or side edge 614 of the wall 606 can be sealed together with the second/longitudinal side edge 622 of the wall 608 along a second closure, and the third or trailing edge 616 of the wall 606 can be sealed or secured together with the corresponding third/trailing edge 624 of the wall 608 along a third closure to form a shipping mailer/envelope 618 (FIG. 31) with the product sealed or encapsulated within it. The sealed mailer/envelope 618 can then be dispatched for further processing, such as labeling/addressing and distribution.

The steps above can be performed in a continuous, in-line process in which the shipping mailer/envelope blanks are produced from bulk feedstock (e.g., by forming the hinge lines and fold lines at the specified locations, applying adhesive, applying opener members, etc.). The shipping mailer/envelope blanks can then be separated from the bulk feedstock, filled, sealed, and sent for further processing. Such systems and methods can provide speed and flexibility for packaging a wide variety of products having different shapes and sizes. For example, the length of the blanks produced can be varied from one blank to the next depending upon the shape and size of the object to be received, allowing customization of the shipping mailer/envelope dimensions to accommodate various products to be packaged in real time and in any specified order. Such systems and methods can be implemented at, for example, facilities or warehouses fulfilling online or e-commerce orders. Such shipping mailers/envelopes can also be produced using excess or waste materials from the production of other cellulosic fiber-based products, as described above.

In other embodiments, the shipping mailer/envelope blanks can be folded and filled before being sealed and/or separated from the bulk feedstock material.

Although the embodiments disclosed herein are described primarily in the context of mailers such as envelopes, the disclosed features can also be applicable to other types of mailers, such as hard or soft-sided boxes, which can include flutes or corrugations on a variety of surfaces that nest in the unassembled state.

Fourth Representative Embodiment

Figure 32:
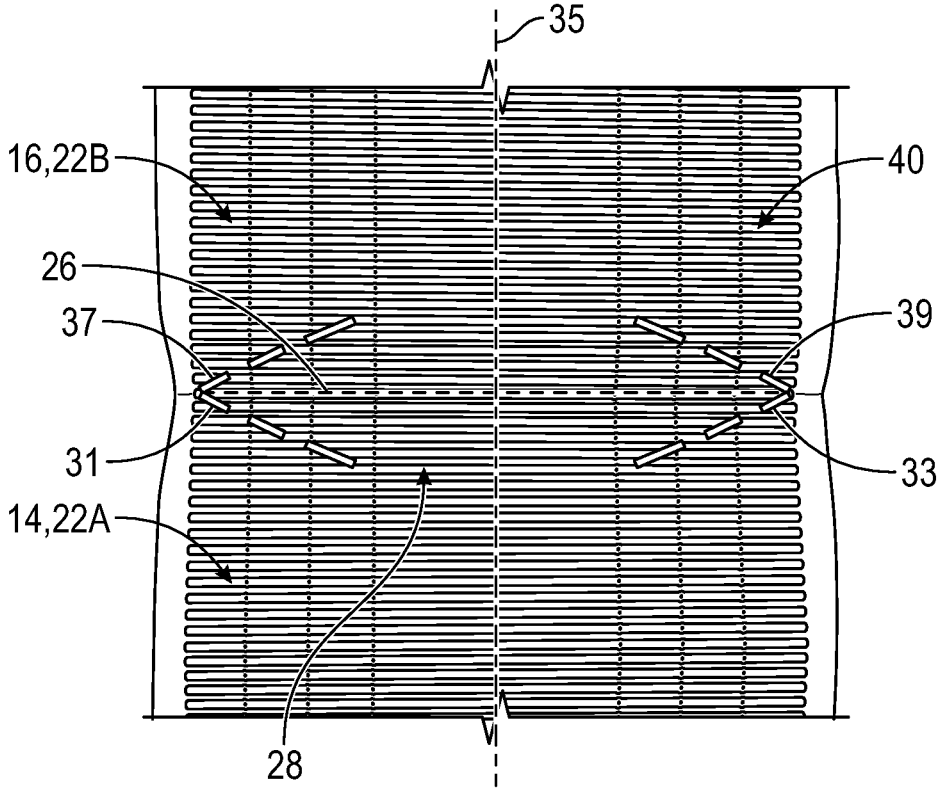
FIG. 32 is a top plan view of a portion of a shipping mailer/envelope in a laid-flat configuration in which the corrugations comprise angled, preformed fold lines at the closed end of the shipping mailer/envelope, according to another embodiment.

FIG. 32 illustrates a portion of another embodiment of a blank for forming the shipping mailer/envelope 10 in a laid flat configuration. In the embodiment of FIG. 32, the shipping mailer/envelope 10 can comprise straight score lines/folds/creases/lines of weakness extending from the edges of the walls adjacent the center fold line 26 and at an angle to the center fold line 26 and/or at an angle to the corrugations 28 generally toward the central axis 35 of the shipping mailer/envelope 10. Corrugations are shown at 28. For example, in the illustrated embodiment the corrugated layer 40 on the interior surface 22A of the first wall 14 comprises preformed fold lines 31 and 33 angled toward each other and extending inwardly from the edges of the blank toward the central axis 35 of the shipping mailer/envelope. The portion of the corrugated layer 40 on the interior surface 22B of the second wall 16 can comprise preformed fold lines 37 and 39, which can also extend at an angle to the fold line 26 and/or to the corrugations 28. In the illustrated embodiment the score lines 31 and 37 converge at or near the longitudinal edge portion of the blank at the fold line 26, as do the fold lines 33 and 39 on the other side of the blank, although in other embodiments the fold lines need not intersect. In FIG. 32 the fold lines 31-39 are shown enlarged for purposes of illustration, but may have any size in practice.

The fold lines 31, 33, 37, and 39 can be configured to induce the walls 14, 16 of the shipping mailer/envelope to fold or bend along the fold lines. The fold lines 31-39 can also induce the walls to bend along one or more corrugations extending between the fold lines 31 and 33 and one or more corrugations extending between the fold lines 37 and 39 when the shipping mailer/envelope is stuffed. For example, in certain embodiments the corrugations along which the closed end portion 21 bends when stuffed can correspond to the thickness of the object received in the shipping mailer/envelope. A thinner object will cause the walls 14 and/or 16 to bend or flex about corrugations closer to the fold line 26, while thicker objects will cause the walls to bend or flex about corrugations farther from the fold line 26. When the closed end 21 of the shipping mailer/envelope flexes along the fold lines 31 and 33, along the fold lines 37 and 39, and along one or more corrugations extending between each pair of fold lines, the closed end can form one or more end surfaces such as the end wall 62 (FIGS. 11C and 14-16). Such surfaces can be at an angle, perpendicular, or substantially perpendicular to the walls 14 and 16, similar to the embodiments described above. As shown in FIG. 32, neither the lines 31 and 33, nor the lines 37 and 39, need intersect. Rather, the relatively short length of the fold lines 31, 33, 37, 39 can be sufficient to induce bending or flexing of the respective walls to form end surfaces or an expanded closed end as the walls 14 and 16 move apart along the z-axis (FIG. 11C) when an object is received in the shipping mailer/envelope. However, in other embodiments the fold lines can intersect (e.g., along the longitudinal axis 35).

The fold lines 31, 33, 37, and 39 can have any length, and can form any angle with the fold line 26 and/or with each other. In certain embodiments, any or all of the fold lines 31, 33, 37, and 39 can be inwardly offset from the longitudinal edges of the shipping mailer/envelope along the fold line 26, and/or can be longitudinally offset from the fold line 26 along the axis 35. Further, the fold lines 31, 33, 37, and/or 39 can have the same length and orientation, as in the illustrated embodiment, or may have different lengths and/or form different angles with each other and/or with the fold line 26.

Fifth Representative Embodiment

Figure 33:
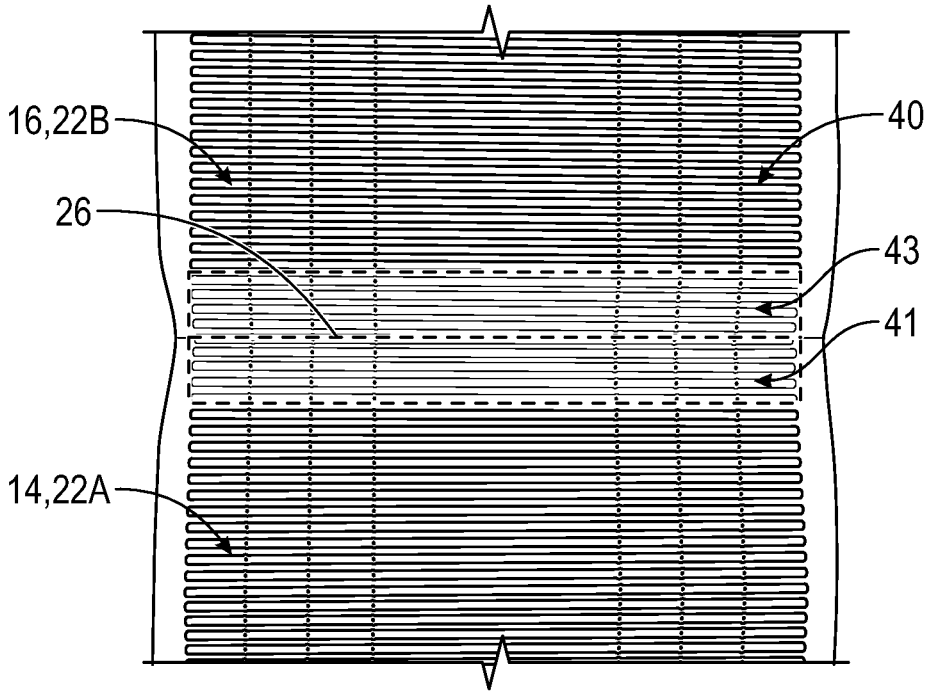
FIG. 33 is a top plan view of a portion of a shipping mailer/envelope in which a region of the corrugated layer at the closed end of the shipping mailer/envelope is flattened or crushed, according to another embodiment.

In certain embodiments, one or both of the wall panels 14 and/or 16 can comprise a portion or region where the corrugations of the corrugated layer 40 are crushed, flattened, scored, or weakened (e.g., by reduced material thickness, etc.) to facilitate bending or folding of the walls in that region. For example, FIG. 33 illustrates another embodiment of the shipping mailer/envelope 10 in which the corrugated layer 40 comprises a first region 41 on the first wall 14 adjacent the fold line 26, and a second region 43 on the second wall 16 on the opposite side of the fold line 26 from the first region 41. In the regions 41 and 43, the corrugations 28 can be crushed, flattened, scored, etc., or otherwise weakened, thereby facilitating bending or folding of the walls 14 and 16 within the regions 41 and 43 to form one or more end surfaces such as the end wall 62 (FIG. 11C), and/or allow the closed end portion to expand when the shipping mailer/envelope is stuffed.

Sixth Representative Embodiment

Figure 34:
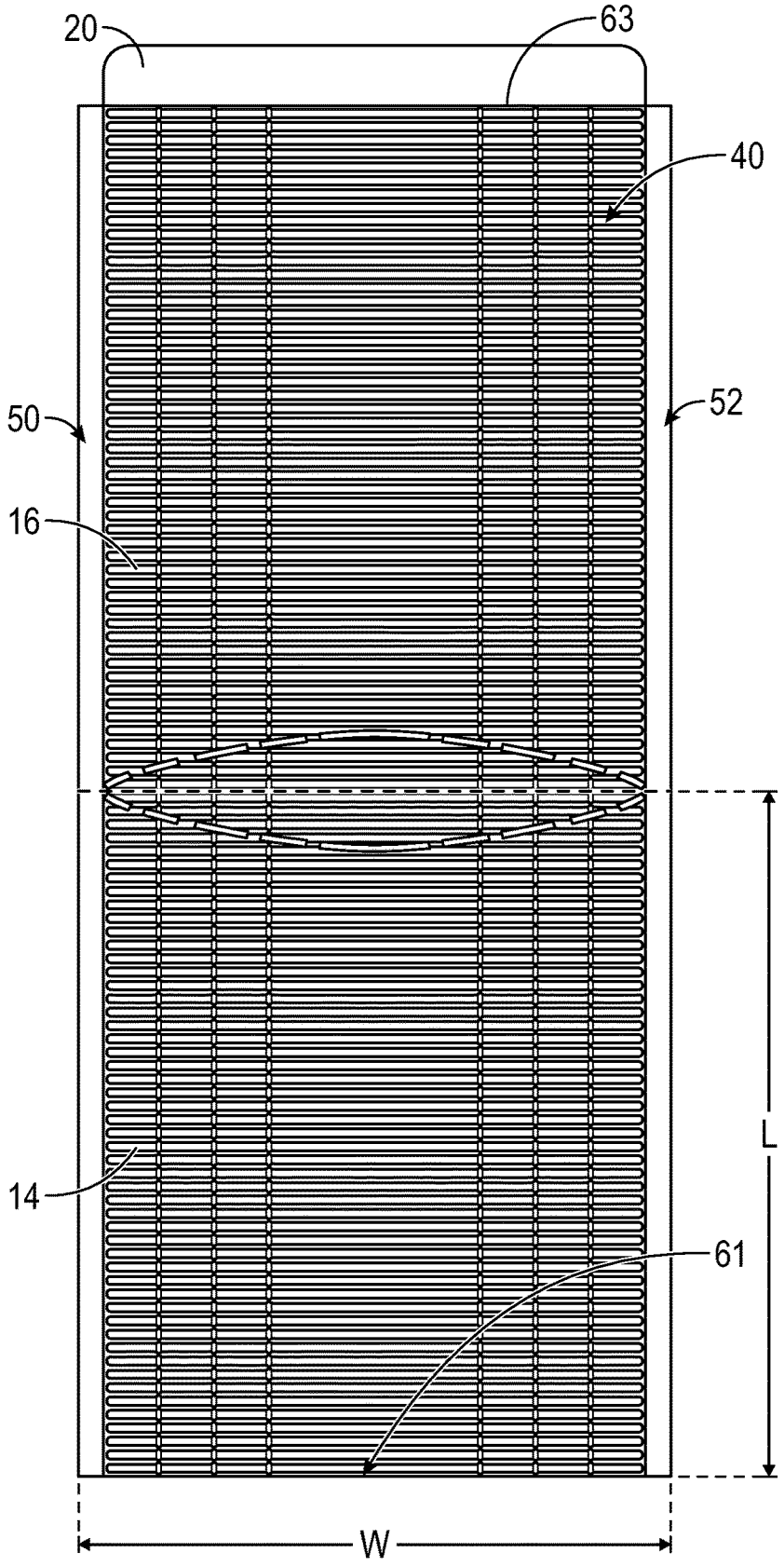
FIG. 34 is a top plan view of another embodiment of a shipping mailer/envelope.

FIG. 34 illustrates another embodiment of the shipping mailer/envelope 10 in a laid-flat state in which the corrugated layer 40 extends between the free edge 61 of the first wall 14 and the flap 20. Edge portions 50 and 52 can extend along the length of the wall 14 from the free edge 61, along the second wall 16, to the fold line 63 of the flap 20. The transition between the edge portions 50, 52 and the flap 20 can be square cutouts or corners formed in the liner layer, as in FIG. 34, or can be tapered, as disclosed elsewhere herein. In particular embodiments, the width W of the shipping mailer/envelope 10 can be from 5 in to 18 in, such as 6 in to 14 in or 6.5 in to 13.5 in. The width of the flap 20 can be less than the width W, as in the illustrated embodiment, or may be the same. In certain embodiments, the flap 20 can comprise sealing or closing means such as a peel-off pressure sensitive tape, adhesive, or any of the other sealing means described herein. The thickness of the liner layer can be from 0.005 in to 0.02 in, such as 0.008 in to 0.013 in, and the thickness of the combination of the liner layer and the corrugated layer can be from 0.03 in to 0.2 in, such as 0.04 in to 0.1 in. In particular embodiments, the length L of the first wall 14 can be from 6 in to 24 in, such as 9 in to 18 in or 9.5 in to 17.5 in. In certain embodiments, the shipping mailer/envelope can be plastic-free or substantially plastic-free, and/or substantially or completely biodegradable at least at the end of its useful life as described above to enable recycling and/or biodegradation.

Additionally, any of the various features shown in the figures can be claimed in any combination in a design. Any of the various features shown in the figures are optional and can be dashed in a design as not being part of the ornamental features of the design with any combination of features shown in solid lines.

Figure 35:
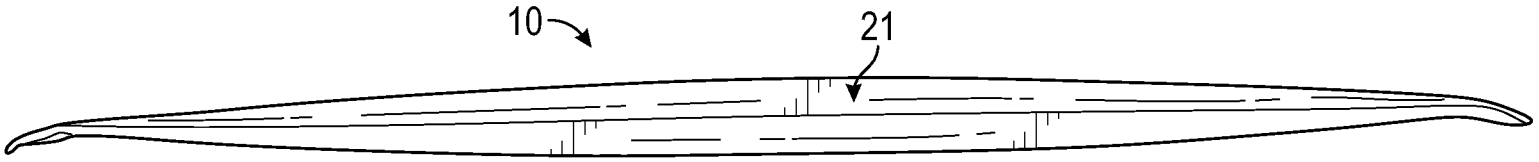
FIG. 35 is an end view of the closed first end portion of the shipping mailer/envelope of FIGS. 7-10.
Figure 36:
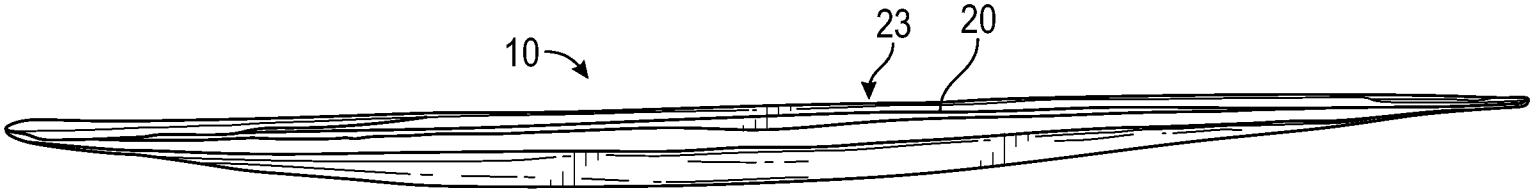
FIG. 36 is an end view of the open second end portion of the shipping mailer/envelope of FIGS. 7-10.
Figure 37:
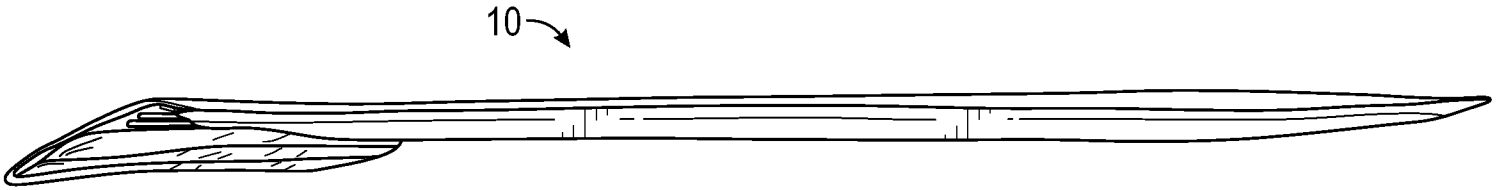
FIG. 37 is a left side view of the shipping mailer/envelope of FIGS. 7-10.
Figure 38:
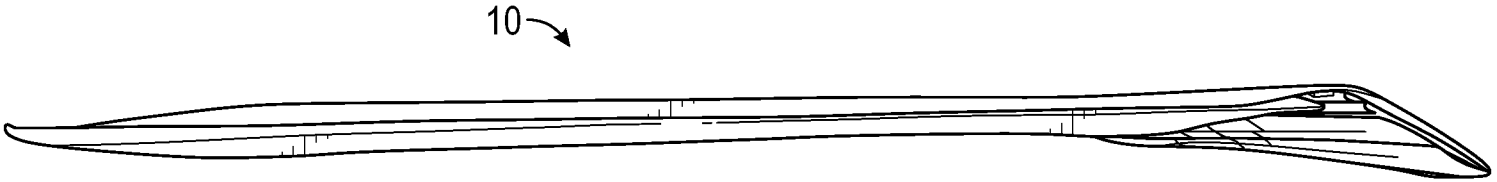
FIG. 38 is a right side view of the shipping mailer/envelope of FIGS. 7-10.
Figure 39:
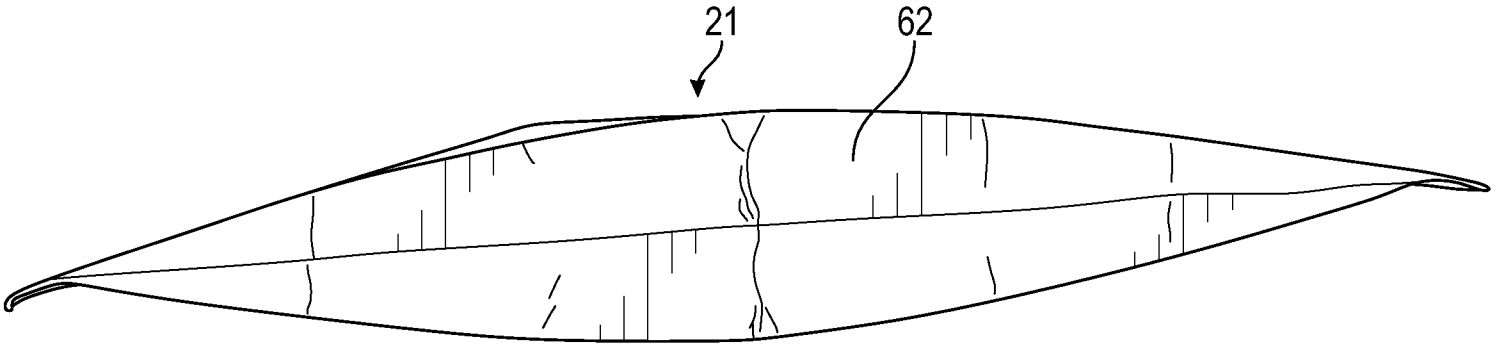
FIG. 39 is an end view of the closed first end portion of the shipping mailer/envelope of FIGS. 7-10 in the stuffed/filled state.
Figure 40:
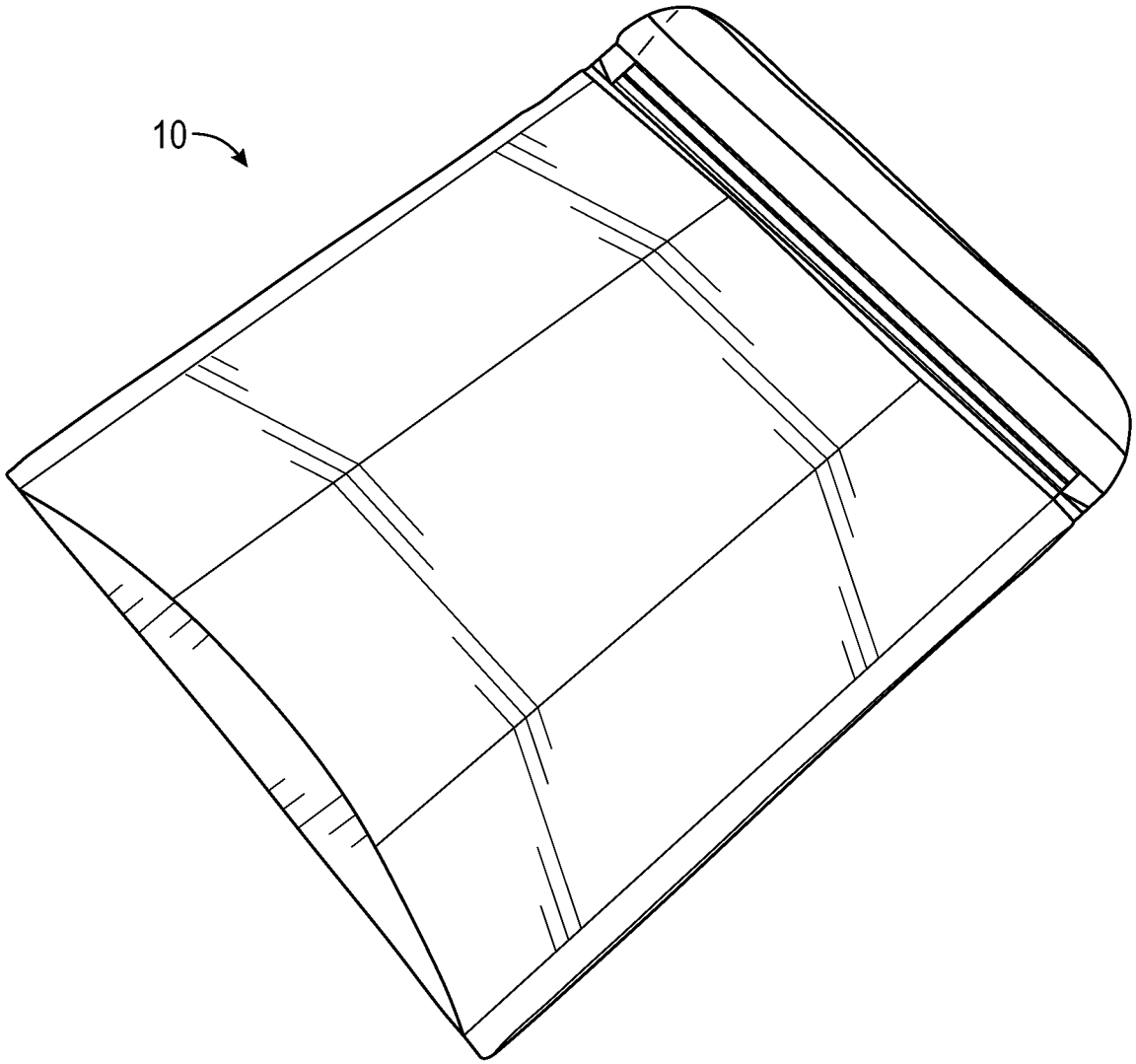
FIG. 40 is a perspective view of the shipping mailer/envelope of FIGS. 7-10.

FIGS. 35-40 illustrate additional views of the shipping mailer/envelope 10. FIG. 35 is an end view of the closed first end portion 21 of the shipping mailer/envelope in the empty or unstuffed state. FIG. 36 is an end view of the open second end portion 23 of the shipping mailer/envelope in the unstuffed state. FIG. 37 is a left side view of the shipping mailer/envelope, and FIG. 38 is a right side view of the shipping mailer/envelope in the unstuffed state. FIG. 39 is an end view of the closed first end portion of the shipping mailer/envelope in the stuffed state and illustrating the end wall 62. FIG. 40 is a perspective view of the shipping mailer/envelope 10 in an unstuffed state.

Explanation of Terms

For purposes of this description, certain aspects, advantages, and novel features of the embodiments of this disclosure are described herein. The disclosed methods, apparatus, and systems should not be construed as being limiting in any way. Instead, the present disclosure is directed toward all novel and nonobvious features and aspects of the various disclosed embodiments, alone and in various combinations and sub-combinations with one another. The methods, apparatus, and systems are not limited to any specific aspect or feature or combination thereof, nor do the disclosed embodiments require that any one or more specific advantages be present or problems be solved.

Although the operations of some of the disclosed embodiments are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods.

As used in this disclosure and in the claims, the singular forms "a," "an," and "the" include the plural forms unless the context clearly dictates otherwise. Additionally, the term "includes" means "comprises." Further, the terms "coupled" and "associated" generally mean electrically, electromagnetically, and/or physically (e.g., mechanically or chemically) coupled or linked and does not exclude the presence of intermediate elements between the coupled or associated items absent specific contrary language.

In some examples, values, procedures, or apparatus may be referred to as "lowest," "best," "minimum," or the like. It will be appreciated that such descriptions are intended to indicate that a selection among many alternatives can be made, and such selections need not be better, smaller, or otherwise preferable to other selections.

In the description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Unless otherwise indicated, all numbers expressing quantities of components, forces, moments, molecular weights, percentages, temperatures, times, and so forth, as used in the specification or claims are to be understood as being modified by the term "about." Accordingly, unless otherwise indicated, implicitly or explicitly, the numerical parameters set forth are approximations that can depend on the desired properties sought and/or limits of detection under test conditions/methods familiar to those of ordinary skill in the art. When directly and explicitly distinguishing embodiments from discussed prior art, the embodiment numbers are not approximates unless the word "about" is recited.

Although there are alternatives for various components, parameters, operating conditions, etc., set forth herein, that does not mean that those alternatives are necessarily equivalent and/or perform equally well. Nor does it mean that the alternatives are listed in a preferred order unless stated otherwise.

In view of the many possible embodiments to which the principles of the disclosed technology may be applied, it should be recognized that the illustrated embodiments are only preferred examples and should not be taken as limiting the scope of the disclosure. Rather, the scope of the disclosure is at least as broad as the following claims. We therefore claim all that comes within the scope and spirit of these claims.

The invention claimed is:

1. An apparatus, comprising:

a shipping mailer that is expandable between a collapsed state and an expanded state, the shipping mailer comprising:

a first wall and a second wall that at least partially define an interior of the shipping mailer, the shipping mailer comprising a closed first end portion and a second end portion, the closed first end portion comprising a hinge line from which the first and second walls extend, the hinge line extending in a first direction across the shipping mailer, the second end portion comprising an opening sealable by a closure;

a plurality of corrugations coupled to the first wall and exposed in the interior of the shipping mailer and extending in the first direction;

a plurality of corrugations coupled to the second wall and exposed in the interior of the shipping mailer and extending in the first direction;

wherein the corrugations of the first wall and the corrugations of the second wall comprise respective first preformed fold lines at the closed first end portion about which the first wall and the second wall are configured to fold when an object is inserted into the shipping mailer to create an end wall extending between the first and second walls at the closed first end portion of the shipping mailer, the first preformed fold lines being curved, the curved first preformed fold lines extending from and returning to the hinge line such that apices of the curved first preformed fold lines are offset from the closed first end portion toward the second end portion; and wherein the corrugations of the first wall and the corrugations of the second wall comprise a plurality of second preformed fold lines that extend from the hinge line across the curved first preformed fold lines and across the corrugations toward the closure, the second preformed fold lines being offset from a longitudinal axis of the shipping mailer toward side edges of the shipping mailer and spaced inwardly away from sealed side edge portions of the shipping mailer; and wherein the curved first preformed fold lines originate from and return to the hinge line at locations spaced inwardly away from the side edges of the shipping mailer.

2. The apparatus of claim 1, wherein the first preformed fold lines are creases or cuts in the corrugations.

3. The apparatus of claim 1, wherein:

the corrugations of the first wall are configured to receive corrugations of the second wall such that the corrugations of the first and second walls nest together when the shipping mailer is in the collapsed state.

4. The apparatus of claim 1, where at least one of the first and second walls comprises a zone in which the corrugations are crushed.

5. The apparatus of claim 1, further comprising a divider between the first wall and the second wall such that the interior of the shipping mailer comprises multiple compartments.

6. The apparatus of claim 1, wherein the first preformed fold line of the corrugations of the first wall is on the opposite side of the hinge line from the first preformed fold line of the corrugations of the second wall.

7. The apparatus of claim 1, wherein the shipping mailer comprises a cellulosic material.

8. The apparatus of claim 1, wherein the shipping mailer is plastic-free.

9. The apparatus of claim 1, wherein the shipping mailer is configured as an envelope.

10. The apparatus of claim 1, wherein the second preformed fold lines are curved.

11. The apparatus of claim 10, wherein the second preformed fold lines are curved such that their concave sides are oriented outwardly toward a nearest longitudinal side edge of the shipping mailer.

12. The apparatus of claim 1, wherein:

the first wall and the second wall comprise a liner layer and a corrugated layer coupled to the liner layer, the plurality of corrugations of the first wall and the plurality of corrugations of the second wall being part of the corrugated layer; and only side edge portions of the liner layer extend beyond side edges of the corrugated layer on both sides of the shipping mailer.

13. The apparatus of claim 12, wherein the curved first preformed fold lines of the first wall and the second wall terminate at or near ends of the corrugations of the corrugated layer.

14. A method of making the apparatus of claim 1, comprising:

applying a corrugated layer to a liner layer;

forming the first preformed fold lines in corrugations of the corrugated layer;

folding the liner layer and the corrugated layer about the hinge line to form the first wall and the second wall; and sealing the first and second walls together along side edge portions of the first and second walls to form the shipping mailer.

15. A method of making the apparatus of claim 1, comprising:

forming the hinge line in a bulk cellulosic fiber-based material;

separating a portion of the bulk cellulosic fiber-based material to form a shipping mailer blank;

folding the shipping mailer blank along the hinge line;

inserting an object into the folded shipping mailer blank; and sealing edge portions of the folded shipping mailer blank to form the shipping mailer and enclose the object in the shipping mailer.

16. The method of claim 15, wherein:

the hinge line extends between walls of the shipping mailer; and the method further comprising forming the curved first preformed fold lines as a plurality of sinusoidally-extending fold lines in the bulk cellulosic fiber-based material.

17. The method of claim 15, wherein the bulk cellulosic fiber-based material comprises paper, paperboard, linerboard, containerboard, card stock, cardboard, kraft paper, single-face corrugated, or any combination thereof.

18. An apparatus, comprising:

a shipping mailer that is expandable between a collapsed state and an expanded state, the shipping mailer comprising:

a first wall and a second wall that at least partially define an interior of the shipping mailer, the shipping mailer comprising a closed first end portion and a second end portion, the closed first end portion comprising a hinge line from which the first and second walls extend, the hinge line extending in a first direction across the shipping mailer, the second end portion comprising an opening sealable by a closure;

a plurality of corrugations coupled to the first wall in the interior of the shipping mailer and extending in the first direction of the hinge line;

a plurality of corrugations coupled to the second wall in the interior of the shipping mailer and extending in the first direction of the hinge line;

wherein the corrugations of the first wall and the corrugations of the second wall comprise respective curved first preformed fold lines at the closed first end portion configured such that when an object is inserted into the shipping mailer, the first and second walls move apart and fold about the curved first preformed fold lines such that the closed first end portion expands to accommodate the object;

wherein the curved first preformed fold lines of the corrugations are curved such that apices of the curved first preformed fold lines are offset from the closed first end portion toward the second end portion;

wherein the curved first preformed fold lines originate from and return to the hinge line at locations spaced inwardly away from side edges of the shipping mailer; and wherein the corrugations of the first wall and the corrugations of the second wall comprise a plurality of second preformed fold lines that extend from the hinge line across the corrugations toward the closure, the second preformed fold lines being spaced inwardly away from sealed side edge portions of the shipping mailer.

19. The apparatus of claim 18, wherein the curved first preformed fold line of the corrugations of the first wall is on the opposite side of the hinge line from the preformed fold line of the corrugations of the second wall.

20. The apparatus of claim 18, wherein the closed first end portion is continuous, and wherein the first and second walls are coupled together along continuous side edges.

21. An apparatus, comprising:

a shipping mailer that is expandable between a collapsed state and an expanded state, the shipping mailer comprising:

a first wall and a second wall that at least partially define an interior of the shipping mailer, the shipping mailer comprising a closed first end portion and a second end portion, the closed first end portion comprising a hinge line from which the first and second walls extend, the hinge line extending in a first direction across the shipping mailer, the second end portion comprising an opening sealable by a closure;

a plurality of corrugations coupled to the first wall in the interior of the shipping mailer and extending in the first direction;

a plurality of corrugations coupled to the second wall in the interior of the shipping mailer and extending in the first direction;

wherein the corrugations of the first wall and the corrugations of the second wall comprise respective first preformed fold lines at the closed first end portion about which the first wall and the second wall are configured to fold when an object is inserted into the shipping mailer to create an end wall extending between the first and second walls at the closed first end portion of the shipping mailer; and wherein the corrugations of the first wall are configured to receive corrugations of the second wall such that the corrugations of the first and second walls nest together when the shipping mailer is in the collapsed state;

wherein the first preformed fold lines originate from and return to the hinge line at locations spaced inwardly away from side edges of the shipping mailer; and wherein the corrugations of the first wall and the corrugations of the second wall comprise a plurality of second preformed fold lines that extend from the hinge line across the corrugations toward the closure, the second preformed fold lines being spaced inwardly away from sealed side edge portions of the shipping mailer.

22. The apparatus of claim 21, wherein the first preformed fold lines of the corrugations are curved such that apices of the first preformed fold lines are offset from the closed first end portion toward the second end portion.

23. The apparatus of claim 21, wherein the first preformed fold lines of the corrugations are straight.

24. The apparatus of claim 23, wherein the first preformed fold lines of the corrugations are angled relative to the first direction of the plurality of corrugations of the first wall and of the second wall.

25. The apparatus of claim 21, wherein the first preformed fold lines are creases or cuts in the corrugations.

26. The apparatus of claim 21, wherein:

the second preformed fold lines extend from the hinge line across the first preformed fold lines toward the closure.

27. The apparatus of claim 26, wherein the second preformed fold lines extend perpendicular or substantially perpendicular to the corrugations.

28. The apparatus of claim 21, wherein:

the first wall and the second wall comprise a liner layer and a corrugated layer coupled to the liner layer, the plurality of corrugations of the first wall and the plurality of corrugations of the second wall being part of the corrugated layer; and only side edge portions of the liner layer extend beyond side edges of the corrugated layer on both sides of the shipping mailer.

* * * * *